US011670220B2

(12) United States Patent
Cong et al.

(10) Patent No.: US 11,670,220 B2
(45) Date of Patent: Jun. 6, 2023

(54) PIXEL CIRCUIT, METHOD FOR DRIVING THE SAME, DISPLAY SUBSTRATE, AND DISPLAY DEVICE

(71) Applicants: Beijing BOE Display Technology Co., Ltd., Beijing (CN); BOE Technology Group Co., Ltd., Beijing (CN)

(72) Inventors: Ning Cong, Beijing (CN); Minghua Xuan, Beijing (CN); Can Zhang, Beijing (CN); Ming Yang, Beijing (CN); Can Wang, Beijing (CN); Lijun Yuan, Beijing (CN)

(73) Assignees: Beijing BOE Display Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 165 days.

(21) Appl. No.: 17/418,808

(22) PCT Filed: Dec. 28, 2020

(86) PCT No.: PCT/CN2020/140327
§ 371 (c)(1),
(2) Date: Jun. 26, 2021

(87) PCT Pub. No.: WO2021/184893
PCT Pub. Date: Sep. 23, 2021

(65) Prior Publication Data

US 2022/0406243 A1 Dec. 22, 2022

(30) Foreign Application Priority Data

Mar. 17, 2020 (CN) ..... 202010188767.7

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2300/0426* (2013.01);
(Continued)

(58) Field of Classification Search
None
See application file for complete search history.

(56) References Cited

U.S. PATENT DOCUMENTS

2007/0091030 A1 4/2007 Drevillon et al.
2011/0285691 A1* 11/2011 Takasugi ..... G09G 3/3233 345/82

(Continued)

FOREIGN PATENT DOCUMENTS

CN 1902676 A 1/2007
CN 107610652 A 1/2018

(Continued)

OTHER PUBLICATIONS

CN202010188767.7 first office action.
CN202010188767.7 Notification to grant patent right for invention.

*Primary Examiner* — Dorothy Harris
(74) *Attorney, Agent, or Firm* — IPro, PLLC

(57) ABSTRACT

A pixel circuit includes a compensating circuit which can adjust an electric potential of a second control node (a gate of a transistor controlling conduction or non-conduction between a first connection node and a second connection node) based on an electric potential of a first control node, and can adjust an electric potential of the second control node based on an electric potential of the second connection node. A method for driving a pixel circuit, a display substrate, and a display device is also provided.

20 Claims, 14 Drawing Sheets

(52) U.S. Cl.
CPC ..... *G09G 2300/0819* (2013.01); *G09G 2300/0842* (2013.01); *G09G 2300/0861* (2013.01); *G09G 2310/08* (2013.01); *G09G 2320/0233* (2013.01); *G09G 2330/021* (2013.01)

(56) References Cited

U.S. PATENT DOCUMENTS

| | | | | |
|---|---|---|---|---|
| 2013/0057532 | A1* | 3/2013 | Lee | G09G 3/3225 345/76 |
| 2016/0372049 | A1* | 12/2016 | Wang | G09G 3/3283 |
| 2018/0130420 | A1* | 5/2018 | Gao | G09G 3/3258 |
| 2018/0166021 | A1* | 6/2018 | Xi | G09G 3/3241 |
| 2019/0096327 | A1 | 3/2019 | Peng et al. | |
| 2019/0259132 | A1 | 8/2019 | Miyasaka et al. | |
| 2020/0020274 | A1 | 1/2020 | Yue et al. | |
| 2020/0286430 | A1* | 9/2020 | Wu | G09G 3/3291 |
| 2021/0027699 | A1 | 1/2021 | Zheng et al. | |
| 2021/0201760 | A1 | 7/2021 | Wang et al. | |
| 2021/0201786 | A1* | 7/2021 | Ma | G09G 3/3233 |
| 2022/0383800 | A1* | 12/2022 | Cong | G09G 3/2081 |

FOREIGN PATENT DOCUMENTS

| | | | |
|---|---|---|---|
| CN | 108847181 | A | 11/2018 |
| CN | 109410837 | A | 3/2019 |
| CN | 109872680 | A | 6/2019 |
| CN | 109920371 | A | 6/2019 |
| CN | 109979378 | A | 7/2019 |
| CN | 110310594 | A | 10/2019 |
| CN | 110782831 | A | 2/2020 |
| CN | 111223443 | A | 6/2020 |
| WO | 2019199777 | A1 | 10/2019 |
| WO | 2020048075 | A1 | 3/2020 |

* cited by examiner

A reset stage, in which an electric potential of a reset signal supplied by the reset signal terminal is a first electric potential; the light-emitting control circuit outputs the second power source signal from the second power source terminal to the first connection node and the first control node in response to the reset signal; the compensating circuit adjusts the electric potential of the second control node according to the electric potential of the first control node; the light-emitting control circuit further controls conduction between the first connection node and the second connection node in response to the electric potential of the second control node; and the compensating circuit further adjusts the electric potential of the second control node according to the electric potential of the second connection node in response to the reset signal — 901

↓

A data writing stage, in which an electric potential of the gate driving signal supplied by the gate signal terminal is the first electric potential; the light-emitting control circuit outputs the second data signal from the second data signal terminal to the first control node in response to the gate driving signal; and the compensating circuit adjusts the electric potential of the second control node according to the electric potential of the first control node — 902

↓

A light-emitting control stage, in which the driving circuit outputs the driving current to the first connection node in response to the first power source signal from the first power source terminal, the gate driving signal and the first data signal from the first data signal terminal; an electric potential of the light-emitting control signal supplied by the light-emitting control signal terminal is the first electric potential; the compensating circuit adjusts the electric potential of the second control node according to the electric potential of the first control node and the third power source signal from the third power source terminal in response to the light-emitting control signal; the light-emitting control circuit controls conduction between the first connection node and the second connection node in response to the electric potential of the second control node, and controls the conduction between the second connection node and the light-emitting element in response to the light-emitting control signal — 903

FIG. 9

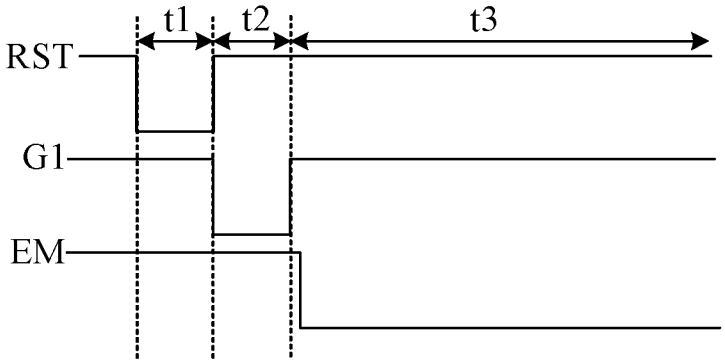

FIG. 10

PIXEL CIRCUIT, METHOD FOR DRIVING THE SAME, DISPLAY SUBSTRATE, AND DISPLAY DEVICE

This application is a US national phase application based on PCT/CN2020/140327, filed on Dec. 28, 2020, which claims priority to the Chinese Patent Application No. 202010188767.7, filed on Mar. 17, 2020 and entitled "PIXEL CIRCUIT, METHOD FOR DRIVING THE SAME, DISPLAY SUBSTRATE, AND DISPLAY DEVICE," the entire content of which is incorporated herein by reference.

TECHNICAL FIELD

The present disclosure relates to the field of display technologies, and in particular, to a pixel circuit, a method for driving the same, a display substrate, and a display device.

BACKGROUND

Micro light-emitting diodes (Micro LEDs) are widely used in various display devices due to their advantages such as high brightness, high light-emitting efficiency, small sizes, and low power consumption.

In the related art, a pixel circuit for driving a Micro LED to emit light generally includes a driving transistor and a switch transistor. The switch transistor can output a data voltage supplied by a data signal terminal coupled thereto to the driving transistor; and the driving transistor can convert the data voltage into a driving current for driving the Micro LED to emit light and output to the Micro LED to drive the Micro LED to emit light.

However, as the magnitude of the driving current is related to a threshold voltage of the driving transistor, drifting of the threshold voltage of the driving transistor may cause the driving current output to the Micro LED to be abnormal, which in turn leads to low uniformity of the display luminance of a Micro LED display device and poor display effect.

SUMMARY

Embodiments of the present disclosure provide a pixel circuit, a method for driving the same, a display substrate, and a display device. The technical solutions are as following.

According to an aspect, a pixel circuit is provided. The pixel circuit includes: a driving circuit, a light-emitting control circuit, and a compensating circuit; wherein the driving circuit is coupled to a first power source terminal, a gate signal terminal, a first data signal terminal, and a first connection node, wherein the driving circuit is configured to output a driving current to the first connection node in response to a first power source signal from the first power source terminal, a gate driving signal from the gate signal terminal, and a first data signal from the first data signal terminal;

the light-emitting control circuit is coupled to the first connection node, the gate signal terminal, a reset signal terminal, a light-emitting control signal terminal, a second power source terminal, a second data signal terminal, a first control node, a second control node, a second connection node, and a light-emitting element, wherein the light-emitting control circuit is configured to output a second power source signal from the second power source terminal to the first connection node and the first control node in response to a reset signal from the reset signal terminal, output a second data signal from the second data signal terminal to the first control node in response to the gate driving signal, control conduction or non-conduction between the second connection node and the light-emitting element in response to a light-emitting control signal from the light-emitting control signal terminal, and control conduction or non-conduction between the first connection node and the second connection node in response to an electric potential of the second control node; and the compensating circuit is coupled to a third power source terminal, the light-emitting control signal terminal, the reset signal terminal, the first control node, the second control node, and the second connection node, wherein the compensating circuit is configured to adjust the electric potential of the second control node based on an electric potential of the first control node, adjust the electric potential of the second control node according to an electric potential of the second connection node in response to the reset signal, and adjust the electric potential of the second control node according to an electric potential of the first control node and a third power source signal from the third power source terminal in response to the light-emitting control signal.

Optionally, the compensating circuit includes a first compensating sub-circuit and a second compensating sub-circuit; wherein the first compensating sub-circuit is coupled to the light-emitting control signal terminal, the third power source terminal, the first control node and the second control node, wherein the first compensating sub-circuit is configured to adjust the electric potential of the second control node according to the electric potential of the first control node, and adjust the electric potential of the second control node according to the third power source signal and the electric potential of the first control node in response to the light-emitting control signal; and the second compensating sub-circuit is coupled to the reset signal terminal, the second connection node, and the second control node, wherein the second compensating sub-circuit is configured to adjust the electric potential of the second control node according to the electric potential of the second connection node in response to the reset signal.

Optionally, the first compensating sub-circuit includes a first compensating transistor, a second compensating transistor, a compensating capacitor, and a compensating resistor; wherein a gate of the first compensating transistor is coupled to the light-emitting control signal terminal, a first electrode of the first compensating transistor is coupled to the third power source terminal, and a second electrode of the first compensating transistor is coupled to the first control node;

a gate of the second compensating transistor is coupled to the light-emitting control signal terminal, a first electrode of the second compensating transistor is coupled to one terminal of the compensating resistor, and a second electrode of the second compensating transistor is coupled to the second control node;

the other terminal of the compensating resistor is coupled to the third power source terminal; and one terminal of the compensating capacitor is coupled to the first control node, and the other terminal of the compensating capacitor is coupled to the second control node.

Optionally, the second compensating sub-circuit includes a third compensating transistor; wherein a gate of the third compensating transistor is coupled to the reset signal terminal, a first electrode of the third compensating transistor is coupled to the second connection node, and a second electrode of the third compensating transistor is coupled to the second control node.

Optionally, the light-emitting control circuit is further configured to output the second power source signal to the light-emitting element in response to the reset signal; and the light-emitting control circuit includes a first reset sub-circuit, a first data writing sub-circuit, a first light-emitting control sub-circuit, and a switch sub-circuit; wherein the first reset sub-circuit is coupled to the reset signal terminal, the second power source terminal, the first connection node, the first control node, and the light-emitting element, wherein the first reset sub-circuit is configured to output the second power source signal to the first connection node, the first control node, and the light-emitting element in response to the reset signal;

the first data writing sub-circuit is coupled to the gate signal terminal, the second data signal terminal, and the first control node, wherein the first data writing sub-circuit is configured to output the second data signal to the first control node in response to the gate driving signal;

the first light-emitting control sub-circuit is coupled to the light-emitting control signal terminal, the second connection node, and the light-emitting element, wherein the first light-emitting control sub-circuit is configured to control conduction or non-conduction between the second connection node and the light-emitting element in response to the light-emitting control signal; and the switch sub-circuit is coupled to the second control node, the first connection node, and the second connection node, wherein the switch sub-circuit is configured to control conduction or non-conduction between the first connection node and the second connection node in response to the electric potential of the second control node.

Optionally, the first reset sub-circuit includes a first reset transistor, a second reset transistor, and a third reset transistor; wherein gates of the first reset transistor, the second reset transistor, and the third reset transistor are all coupled to the reset signal terminal;

first electrodes of the first reset transistor, the second reset transistor, and the third reset transistor are all coupled to the second power source terminal; and a second electrode of the first reset transistor is coupled to the first connection node, a second electrode of the second reset transistor is coupled to the first control node, and a second electrode of the third reset transistor is coupled to the light-emitting element.

Optionally, the first data writing sub-circuit includes a first data writing transistor; wherein a gate of the first data writing transistor is coupled to the gate signal terminal, a first electrode of the first data writing transistor is coupled to the second data signal terminal, and a second electrode of the first data writing transistor is coupled to the first control node.

Optionally, the first light-emitting control sub-circuit includes a first light-emitting control transistor; wherein a gate of the first light-emitting control transistor is coupled to the light-emitting control signal terminal, a first electrode of the first light-emitting control transistor is coupled to the second connection node, and a second electrode of the first light-emitting control transistor is coupled to the light-emitting element.

Optionally, the switch sub-circuit includes a switch transistor; wherein a gate of the switch transistor is coupled to the second control node, a first electrode of the switch transistor is coupled to the first connection node, and a second electrode of the switch transistor is coupled to the second connection node.

Optionally, the pixel circuit further includes a switch control circuit connected in series between the driving circuit and the first connection node; wherein the switch control circuit is coupled to the light-emitting control signal terminal, the driving circuit, and the first connection node; and the switch control circuit is configured to control conduction or non-conduction between the driving circuit and the first connection node in response to the light-emitting control signal.

Optionally, the switch control circuit includes a switch control transistor; wherein a gate of the switch control transistor is coupled to the light-emitting control signal terminal, a first electrode of the switch control transistor is coupled to the driving circuit, and a second electrode of the switch control transistor is coupled to the first connection node.

Optionally, the driving circuit includes a second data writing sub-circuit, a second reset sub-circuit, a second light-emitting control sub-circuit, a storage sub-circuit, a third compensating sub-circuit, and a driving sub-circuit; wherein the second data writing sub-circuit is coupled to the gate signal terminal, the first data signal terminal, and a third connection node; and the second data writing sub-circuit is configured to output the first data signal to the third connection node in response to the gate driving signal;

the second reset sub-circuit is coupled to the reset signal terminal, the second power source terminal, and a third control node; and the second reset sub-circuit is configured to output the second power source signal to the third control node in response to the reset signal;

the second light-emitting control sub-circuit is coupled to the light-emitting control signal terminal, the first power source terminal, and the third connection node; and the second light-emitting control sub-circuit is configured to output the first power source signal to the third connection node in response to the light-emitting control signal;

the storage sub-circuit is coupled to the third control node and the first power source terminal; and the storage sub-circuit is configured to control an electric potential of the third control node;

the third compensating sub-circuit is coupled to the gate signal terminal, the first connection node, and the third control node; and the third compensating sub-circuit is configured to adjust the electric potential of the third control node according to the electric potential of the first connection node in response to the gate driving signal; and the driving sub-circuit is respectively coupled to the third control node, the third connection node, and the first connection node; the driving sub-circuit is configured to output a driving current to the first connection node in response to the electric potential of the third control node and an electric potential of the third connection node.

Optionally, the second data writing sub-circuit includes a second data writing transistor; the second reset sub-circuit includes a fourth reset transistor; the second light-emitting control sub-circuit includes a second light-emitting control transistor; the storage sub-circuit includes a storage capacitor; the third compensating sub-circuit includes a fourth compensating transistor; and the driving sub-circuit includes a driving transistor; wherein a gate of the second data writing transistor is coupled to the gate signal terminal, a first electrode of the second data writing transistor is coupled to the first data signal terminal, and a second electrode of the second data writing transistor is coupled to the third connection node;

a gate of the fourth reset transistor is coupled to the reset signal terminal, a first electrode of the fourth reset transistor is coupled to the second power source terminal, and a second electrode of the fourth reset transistor is coupled to the third control node;

a gate of the second light-emitting control transistor is coupled to the light-emitting control signal terminal, a first electrode of the second light-emitting control transistor is coupled to the first power source terminal, and a second electrode of the second light-emitting control transistor is coupled to the third connection node;

one terminal of the storage capacitor is coupled to the third control node, and the other terminal of the storage capacitor is coupled to the first power source terminal;

a gate of the fourth compensating transistor is coupled to the gate signal terminal, a first electrode of the fourth compensating transistor is coupled to the first connection node, and a second electrode of the fourth compensating transistor is coupled to the third control node; and a gate of the driving transistor is coupled to the third control node, a first electrode of the driving transistor is coupled to the third connection node, and a second electrode of the driving transistor is coupled to the first connection node.

According to another aspect, a method for driving a pixel circuit is provided. The method is applicable to the above pixel circuit and includes:

a reset stage, in which an electric potential of a reset signal supplied by the reset signal terminal is a first electric potential; the light-emitting control circuit outputs the second power source signal from the second power source terminal to the first connection node and the first control node in response to the reset signal; the compensating circuit adjusts the electric potential of the second control node according to the electric potential of the first control node; the light-emitting control circuit further controls conduction between the first connection node and the second connection node in response to the electric potential of the second control node; and the compensating circuit further adjusts the electric potential of the second control node according to the electric potential of the second connection node in response to the reset signal;

a data writing stage, in which an electric potential of the gate driving signal supplied by the gate signal terminal is the first electric potential; the light-emitting control circuit outputs the second data signal from the second data signal terminal to the first control node in response to the gate driving signal; and the compensating circuit adjusts the electric potential of the second control node according to the electric potential of the first control node; and a light-emitting control stage, in which the driving circuit outputs the driving current to the first connection node in response to the first power source signal from the first power source terminal, the gate driving signal, and the first data signal from the first data signal terminal; an electric potential of the light-emitting control signal supplied by the light-emitting control signal terminal is the first electric potential; the compensating circuit adjusts the electric potential of the second control node according to the electric potential of the first control node and the third power source signal from the third power source terminal in response to the light-emitting control signal; and the light-emitting control circuit controls conduction between the first connection node and the second connection node in response to the electric potential of the second control node, and controls conduction between the second connection node and the light-emitting element in response to the light-emitting control signal.

According to yet another aspect, a display substrate is provided. The display substrate includes: a plurality of pixel units, wherein at least one of the plurality of pixel units includes a light-emitting element and a pixel circuit coupled to the light-emitting element and defined in the above aspect.

Optionally, the light-emitting element includes a micro light-emitting diode.

According to yet another aspect, a display device is provided. The display device includes: a signal driving circuit and a display substrate as defined in the above aspect; wherein the signal driving circuit is coupled to each signal terminal of the pixel circuit included in the display substrate, and is configured to supply signal to the each signal terminal.

BRIEF DESCRIPTION OF THE DRAWINGS

To describe the technical solutions in the embodiments of the present disclosure more clearly, the following briefly introduces the accompanying drawings required for describing the embodiments. Apparently, the accompanying drawings in the following description show merely some embodiments of the present disclosure, and a person of ordinary skill in the art may still derive other drawings from these accompanying drawings without creative efforts.

FIG. 9 is a flow chart of a method for driving a pixel circuit according to an embodiment of the present disclosure;

FIG. 10 is a timing diagram of each signal terminal of a pixel circuit according to an embodiment of the present disclosure;

DETAILED DESCRIPTION

For clearer descriptions of the objectives, technical solutions, and advantages of embodiments of the present disclosure, the embodiments of the present disclosure are described in detail hereinafter with reference to the accompanying drawings.

The transistors used in all the embodiments of the present disclosure may be thin film transistors or field effect transistors or other devices with the same characteristics. According to functions in a circuit, the transistors used in the embodiments of the present disclosure are mainly switch transistors. Since a source electrode and a drain electrode of the switch transistor used here are symmetrical, the source electrode and the drain electrode are interchangeable. In the embodiments of the present disclosure, the source electrode is referred to as a first electrode and the drain electrode is referred to as a second electrode. Or, the drain electrode may be referred to as the first electrode and the source electrode is referred to as the second electrode. According to forms in the accompanying drawings, it is specified that for the transistor, a middle terminal is a gate, a signal input terminal is the source electrode, and a signal output terminal is the drain electrode. The switch transistors used in the embodiments of the present disclosure may be P-type switch transistors. The P-type switch transistor is conducted when the gate is at a low level and is non-conducted when the gate is at a high level. In addition, each signal in various embodiments of the present disclosure corresponds to a first electric potential and a second electric potential. The first electric potential and the second electric potential represent only two state quantities of the electric potential of the signal, and do not represent that the first electric potential or the second electric potential herein has a specific value. The embodiments of the present disclosure take an effective electric potential as an example of the first electric potential for illustration.

Figure 1:
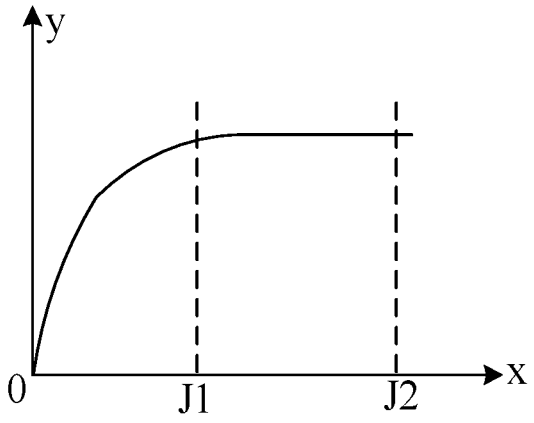
FIG. 1 is a schematic diagram of light-emitting efficiency and current density of a micro LED according to an embodiment of the present disclosure.

A Micro LED may be understood as a self-luminous element after miniaturization and matrix of LEDs, and a light-emitting efficiency thereof has a certain relationship with a current density of a driving current output to the Micro LED. For example, FIG. 1 shows a relationship between the light-emitting efficiency and the current density of the Micro LED. As shown in FIG. 1, a horizontal axis, that is, an x-axis, may refer to the current density, and a vertical axis, that is, a y-axis, may refer to the light-emitting efficiency.

With reference to FIG. 1, it can be seen that the light-emitting efficiency of the Micro LED changes with the current density. The light-emitting efficiency of the Micro LED changes significantly at a low current density (the 0-J1 interval shown in FIG. 1), and the light-emitting efficiency of the Micro LED is more stable and does not change significantly at a high current density (the J1-J2 interval as shown in FIG. 1). Color coordinates of the Micro LED may also change with the current density. If a pixel circuit in related art is adopted to drive the Micro LED to emit light, a light-emitting luminance of the Micro LED may also be affected by drifting of the threshold voltage. In the related art, stability of the light-emitting efficiency of the Micro LED is less stable, and a display uniformity of a Micro LED display device is relatively poor.

The embodiments of the present disclosure provide a pixel circuit, which not only can avoid the phenomenon of a poor display luminance uniformity caused by drifting of the threshold voltage of the driving transistor, but also can control a gray scale by adjusting both the magnitude of the driving current and an emission time of the Micro LED, which ensures that the Micro LED can always work at the high current density, that is, the light-emitting efficiency of the Micro LED can always be stable.

Figure 2:
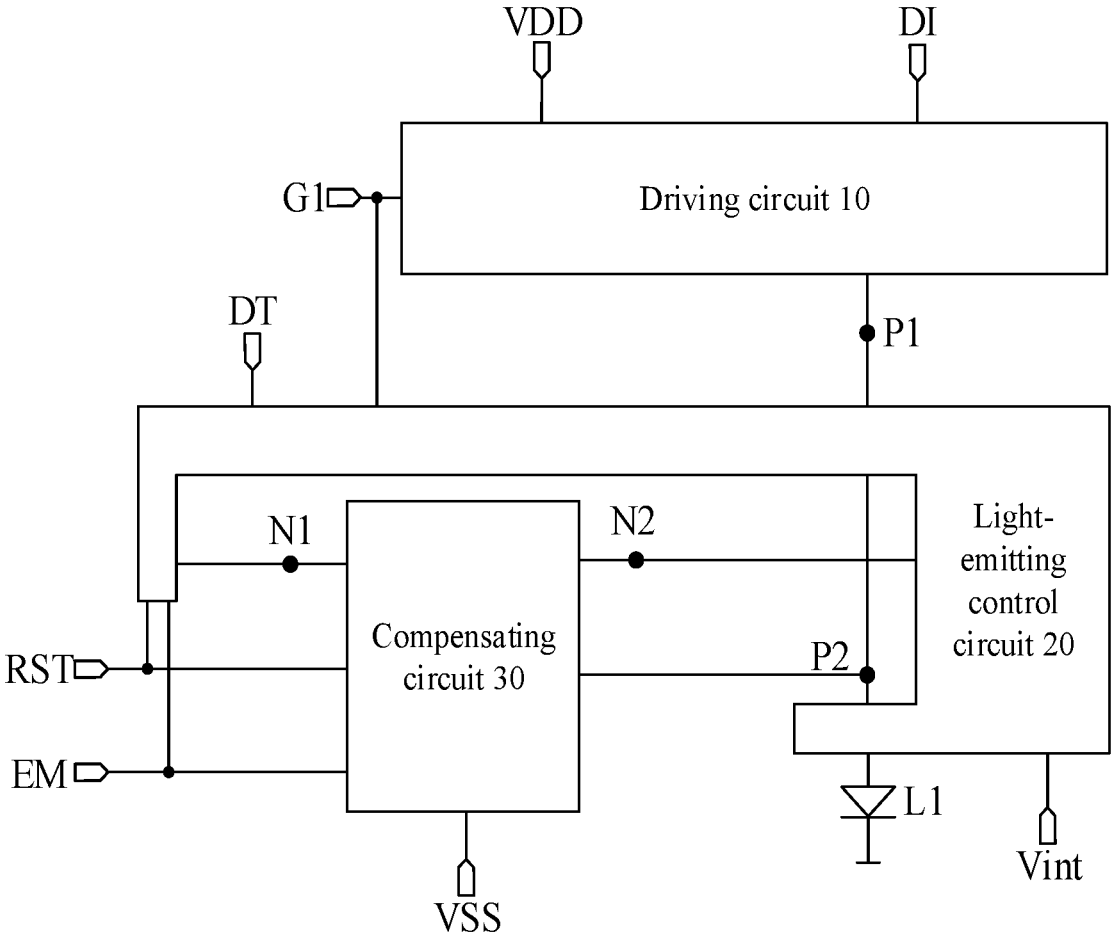
FIG. 2 is a schematic diagram of a pixel circuit according to an embodiment of the present disclosure.

FIG. 2 is a schematic diagram of a pixel circuit according to an embodiment of the present disclosure. As shown in FIG. 2, the pixel circuit may include: a driving circuit 10, a light-emitting control circuit 20, and a compensating circuit 30.

The driving circuit 10 may be coupled to a first power source terminal VDD, a gate signal terminal G1, a first data signal terminal DI, and a first connection node P1, respectively. The driving circuit 10 may output a driving current to the first connection node P1 in response to a first power source signal from the first power source terminal VDD, a gate driving signal from the gate signal terminal G1, and a first data signal from the first data signal terminal DI.

The light-emitting control circuit 20 may be coupled to the first connection node P1, the gate signal terminal G1, a reset signal terminal RST, a light-emitting control signal terminal EM, a second power source terminal Vint, a second data signal terminal DT, a first control node N1, a second control node N2, a second connection node P2, and a light-emitting element L1, respectively. The light-emitting control circuit 20 may be configured to output a second power source signal from the second power source terminal Vint to the first connection node P1 and the first control node N1 in response to a reset signal from the reset signal terminal RST, output a second data signal from the second data signal terminal DT to the first control node N1 in response to the gate driving signal, control conduction or non-conduction between the second connection node P2 and the light-emitting element L1 in response to a light-emitting control signal from the light-emitting control signal terminal EM, and control conduction or non-conduction between the first connection node P1 and the second connection node P2 in response to an electric potential of the second control node N2.

For example, the light-emitting control circuit 20 may output the second power source signal from the second power source terminal Vint to the first connection node P1 and the first control node N1 when the electric potential of the reset signal supplied by the reset signal terminal RST is a first electric potential. The electric potential of the second power source signal may be a second electric potential, so as to reset the first connection node P1 and the first control node N1. Optionally, the first electric potential may be an effective electric potential, the second electric potential may be an ineffective electric potential. Besides, the first electric potential may be a low potential relative to the second electric potential, that is, the voltage of a signal at the first electric potential is less than the voltage of the signal at the second electric potential.

For another example, the light-emitting control circuit 20 may output the second data signal from the second data signal terminal DT to the first control node N1 when the electric potential of the gate driving signal supplied by the gate signal terminal G1 is the first electric potential. When the electric potential of the light-emitting control signal supplied by the light-emitting control signal terminal EM is the first electric potential, the light-emitting control circuit 20 may control conduction between the second connection node P2 and the light-emitting element L1. In addition, when the electric potential of the second control node N2 is the first electric potential, the light-emitting control circuit 20 may control conduction between the first connection node P1 and the second connection node P2. If the first electric potential is a low potential relative to the second electric potential, that is, when the electric potential of the second control node N2 is less than an electric potential threshold, the light-emitting control circuit 20 may control conduction between the first connection node P1 and the second connection node P2.

The compensating circuit 30 may be coupled to a third power source terminal VSS, the light-emitting control signal terminal EM, the reset signal terminal RST, the first control node N1, the second control node N2, and the second connection node P2, respectively. The compensating circuit 30 may adjust the electric potential of the second control node N2 according to an electric potential of the first control node N1, adjust the electric potential of the second control node N2 according to an electric potential of the second connection node P2 in response to the reset signal, and adjust the electric potential of the second control node N2 according to an electric potential of the first control node N1 and a third power source signal from the third power source terminal VSS in response to the light-emitting control signal.

For example, the compensating circuit 30 may adjust the electric potential of the second control node N2 according to the electric potential of the first control node N1 by a coupling effect. The compensating circuit 30 may adjust the electric potential of the second control node N2 according to the electric potential of the second connection node P2 when the electric potential of the reset signal is the first electric potential. Moreover, the compensating circuit 30 may adjust the electric potential of the second control node N2 according to the electric potential of the first control node N1 and the third power source signal when the electric potential of the light-emitting control signal is the first electric potential.

Optionally, an electric potential of the third power source signal may be a third electric potential, and the third electric potential may also be a low potential relative to the second electric potential. For example, the third power source signal terminal VSS may be a ground terminal.

Based on functions of the above circuits, it can be concluded that the driving circuit 10 described in the embodiment of the present disclosure may control the magnitude of the driving current according to the first data signal. The light-emitting control circuit 20 and the compensating circuit 30 may control a time period of the driving current output to the light-emitting element L1 according to the second data signal, that is, control an emission time of the light-emitting element L1. Correspondingly, the first data signal may also be referred to as a current control data signal, and the second data signal may also be referred to as a time period control data signal. The driving circuit 10 may be referred to as a current control circuit. The circuit formed by the light-emitting control circuit 20 and the compensating circuit 30 may be referred to as a time control circuit.

In summary, the embodiment of the present disclosure provides a pixel circuit. The pixel circuit includes a compensating circuit. The compensating circuit can adjust an electric potential of a second control node (that is, a gate of a transistor controlling conduction or non-conduction between a first connection node and a second connection node) according to an electric potential of a first control node, and adjust an electric potential of the second control node according to an electric potential of the second connection node (that is, a second electrode of a transistor controlling conduction or non-conduction between the first connection node and the second connection node). When the pixel circuit is driven, electric potential of each control signal can be controlled, such that influence of a threshold voltage of a transistor on an electric potential finally output to the second control node is relatively small, that is, influence of drifting of a threshold voltage on display uniformity is reduced. The display device according to the present disclosure achieves a good display effect.

Figure 3:
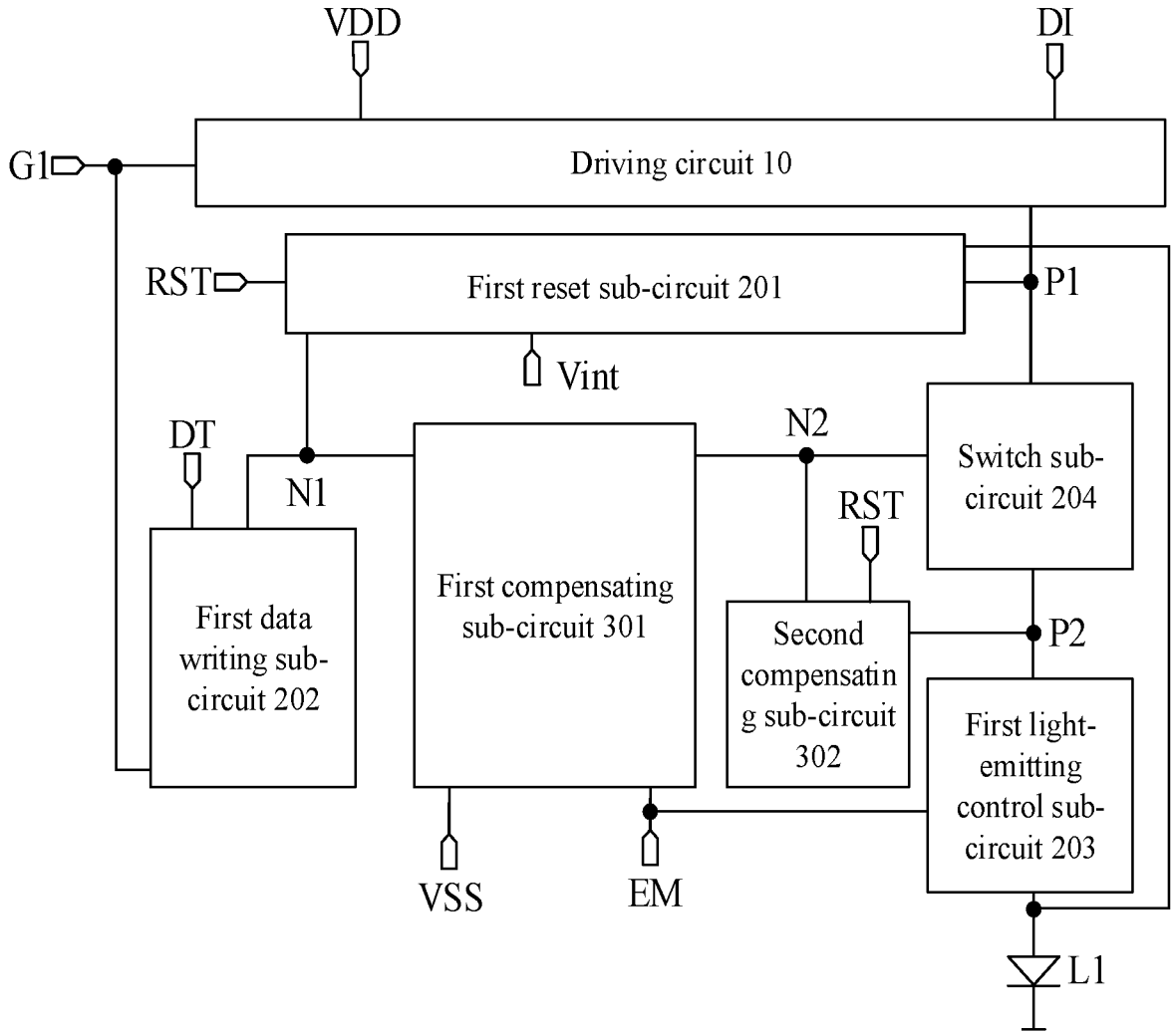
FIG. 3 is a schematic diagram of another pixel circuit according to an embodiment of the present disclosure.

FIG. 3 is a schematic diagram of another pixel circuit according to an embodiment of the present disclosure. As shown in FIG. 3, the compensating circuit 30 may include: a first compensating sub-circuit 301 and a second compensating sub-circuit 302.

The first compensating sub-circuit 301 may be coupled to the light-emitting control signal terminal EM, the third power source terminal VSS, the first control node N1, and the second control node N2, respectively. The first compensating sub-circuit 301 may adjust the electric potential of the second control node N2 according to the electric potential of the first control node N1, and adjust the electric potential of the second control node N2 based on the third power source signal and the electric potential of the first control node N1 in response to the light-emitting control signal.

For example, the first compensating sub-circuit 301 may adjust the electric potential of the second control node N2 according to the electric potential of the first control node N1 by a coupling effect, and may adjust the electric potential of the second control node N2 according to the third power source signal and the electric potential of the first control node N1 when the electric potential of the light-emitting control signal is the first electric potential. Optionally, if the effective electric potential is a low potential, the first compensating sub-circuit 301 may pull down the electric potential of the first control node N1 by the third power source signal, and then further pull down the electric potential of the second control node N2 based on the electric potential of the first control node N1, so as to adjust the electric potential of the second control node N2.

The second compensating sub-circuit 302 may be coupled to the reset signal terminal RST, the second connection node P2, and the second control node N2, respectively. The second compensating sub-circuit 302 may adjust the electric potential of the second control node N2 according to the electric potential of the second connection node P2 in response to the reset signal.

For example, the second compensating sub-circuit 302 may adjust the electric potential of the second control node N2 according to the electric potential of the second connection node P2 when the electric potential of the reset signal is the first electric potential.

Figure 4:
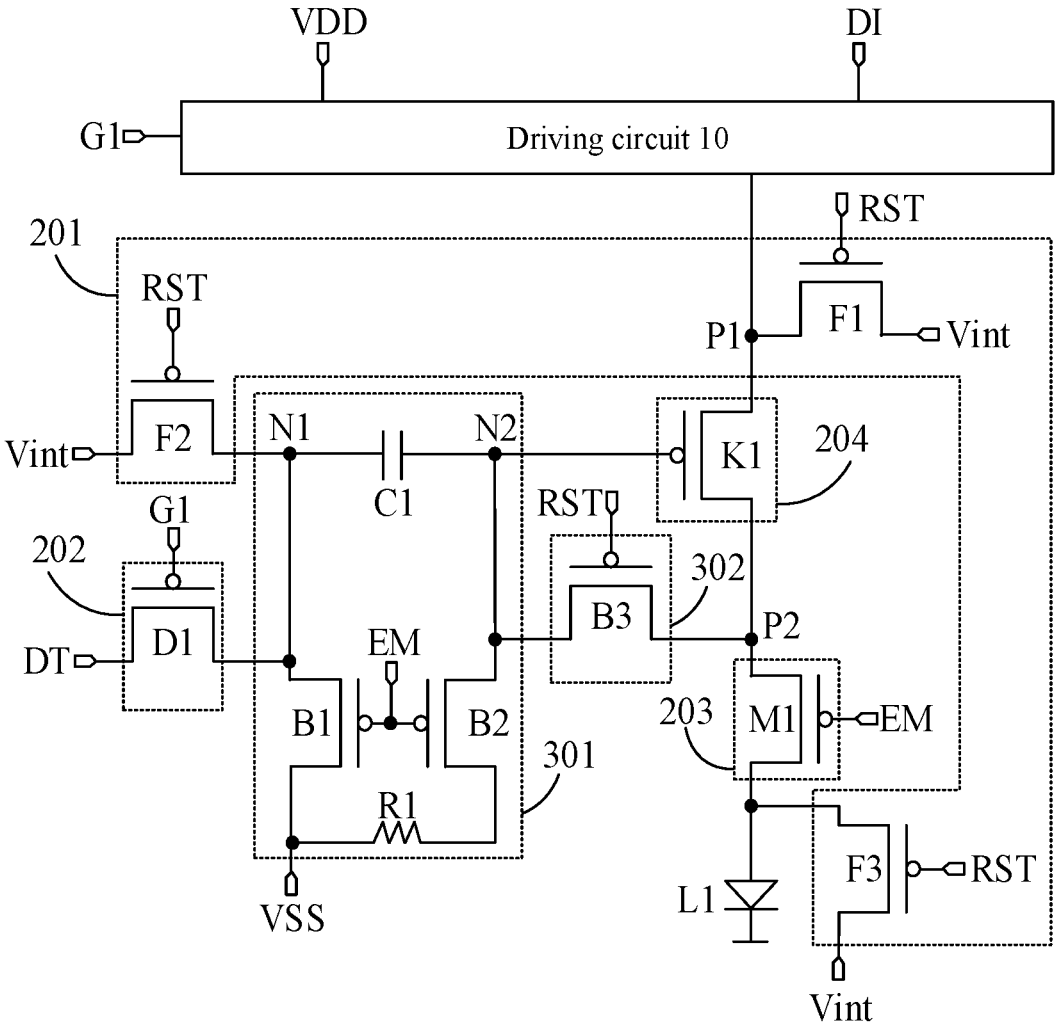
FIG. 4 is a schematic diagram of still another pixel circuit according to an embodiment of the present disclosure.

FIG. 4 is a schematic diagram of still another pixel circuit according to an embodiment of the present disclosure. As shown in FIG. 4, the first compensating sub-circuit 301 may include: a first compensating transistor B1, a second compensating transistor B2, a compensating capacitor C1, and a compensating resistor R1.

Referring to FIG. 4, a gate of the first compensating transistor B1 may be coupled to the light-emitting control signal terminal EM, a first electrode of the first compensating transistor B1 may be coupled to the third power source terminal VSS, and a second electrode of the first compensating transistor B1 may be coupled to the first control node N1.

A gate of the second compensating transistor B2 may be coupled to the light-emitting control signal terminal EM, a first electrode of the second compensating transistor B2 may be coupled to one terminal of the compensating resistor R1, and a second electrode of the second compensating transistor B2 may be coupled to the second control node N2.

The other terminal of the compensating resistor R1 may be coupled to the third power source terminal VSS.

One terminal of the compensating capacitor C1 may be coupled to the first control node N1, and the other terminal of the compensating capacitor C1 may be coupled to the second control node N2.

Optionally, referring to FIG. 4, the second compensating sub-circuit 302 may include: a third compensating transistor B3.

A gate of the third compensating transistor B3 may be coupled to the reset signal terminal RST, a first electrode of the third compensating transistor B3 may be coupled to the second connection node P2, and a second electrode of the third compensating transistor B3 may be coupled to the second control node N2.

Optionally, the light-emitting control circuit 20 may further output the second power source signal to the light-emitting element L1 in response to the reset signal. With continued reference to FIG. 3, the light-emitting control circuit 20 may include a first reset sub-circuit 201, a first data writing sub-circuit 202, a first light-emitting control sub-circuit 203, and a switch sub-circuit 204.

The first reset sub-circuit 201 may be coupled to the reset signal terminal RST, the second power source terminal Vint, the first connection node P1, the first control node N1, and the light-emitting element L1, respectively. The first reset sub-circuit 201 may output the second power source signal to the first connection node P1, the first control node N1, and the light-emitting element L1 in response to the reset signal.

For example, the first reset sub-circuit 201 may output the second power source signal at the second electric potential to the first connection node P1, the first control node N1, and the light-emitting element L1 when the electric potential of the reset signal is the first electric potential, so as to reset the first connection node P1, the first control node N1, and the light-emitting element L1.

The first reset sub-circuit 201 is disposed to firstly reset the first connection node P1, the first control node N1, and the light-emitting element L1, such that each circuit included in both the light-emitting control circuit 20 and the compensating circuit 30 can start to work from the same electric potential, which ensures working reliability of the pixel circuit.

The first data writing sub-circuit 202 may be coupled to the gate signal terminal G1, the second data signal terminal DT, and the first control node N1, respectively. The first data writing sub-circuit 202 may output the second data signal to the first control node N1 in response to the gate driving signal.

For example, the first data writing sub-circuit 202 may output the second data signal to the first control node N1 when the electric potential of the gate driving signal is the first electric potential.

The first light-emitting control sub-circuit 203 may be coupled to the light-emitting control signal terminal EM, the second connection node P2, and the light-emitting element L1, respectively. The first light-emitting control sub-circuit 203 may control conduction or non-conduction between the second connection node P2 and the light-emitting element L1 in response to the light-emitting control signal.

For example, the first light-emitting control sub-circuit 203 may control conduction between the second connection node P2 and the light-emitting element L1 when the electric potential of the light-emitting control signal is the first electric potential.

The switch sub-circuit 204 may be coupled to the second control node N2, the first connection node P1, and the second connection node P2, respectively. The switch sub-circuit 204 may control conduction or non-conduction between the first connection node P1 and the second connection node P2 in response to the electric potential of the second control node N2.

For example, the switch sub-circuit 204 may control conduction between the first connection node P1 and the second connection node P2 when the electric potential of the second control node N2 is the first electric potential.

With continued reference to FIG. 4, the first reset sub-circuit 201 may include: a first reset transistor F1, a second reset transistor F2, and a third reset transistor F3.

Gates of the first reset transistor F1, the second reset transistor F2, and the third reset transistor F3 may be all coupled to the reset signal terminal RST.

First electrodes of the first reset transistor F1, the second reset transistor F2, and the third reset transistor F3 may be all coupled to the second power source terminal Vint.

A second electrode of the first reset transistor F1 may be coupled to the first connection node P1, a second electrode of the second reset transistor F2 may be coupled to the first control node N1, and a second electrode of the third reset transistor F3 may be coupled to the light-emitting element L1.

Optionally, with continued reference to FIG. 4, the first data writing sub-circuit 202 may include: a first data writing transistor D1.

A gate of the first data writing transistor D1 may be coupled to the gate signal terminal G1, a first electrode of the first data writing transistor D1 may be coupled to the second data signal terminal DT, and a second electrode of the first data writing transistor D1 may be coupled to the first control node N1.

Optionally, with continued reference to FIG. 4, the first light-emitting control sub-circuit 203 may include: a first light-emitting control transistor M1.

A gate of the first light-emitting control transistor M1 may be coupled to the light-emitting control signal terminal EM, a first electrode of the first light-emitting control transistor M1 may be coupled to the second connection node P2, and a second electrode of the first light-emitting control transistor M1 may be coupled to the light-emitting element L1.

Optionally, with continued reference to FIG. 4, the switch sub-circuit 204 may include: a switch transistor K1.

A gate of the switch transistor K1 may be coupled to the second control node N2, a first electrode of the switch transistor K1 may be coupled to the first connection node P1, and a second electrode of the switch transistor K1 may be coupled to the second connection node P2.

Figure 5:
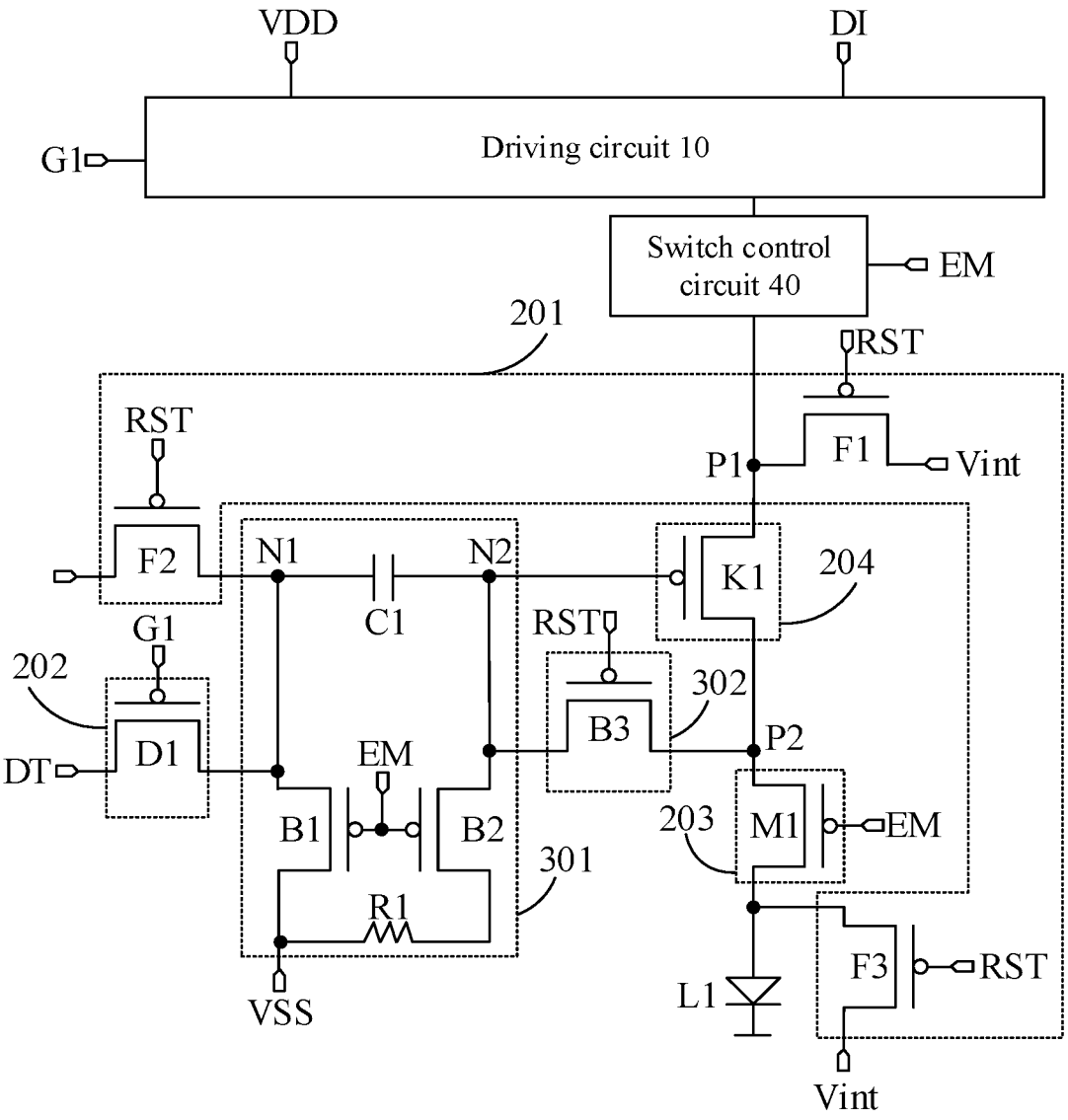
FIG. 5 is a schematic diagram of still another pixel circuit according to an embodiment of the present disclosure.

FIG. 5 is a schematic diagram of still another pixel circuit according to an embodiment of the present disclosure. As shown in FIG. 5, the pixel circuit may further include: a switch control circuit 40 connected in series between the driving circuit 10 and the first connection node P1.

The switch control circuit 40 may be coupled to the light-emitting control signal terminal EM, the driving circuit 10, and the first connection node P1, respectively. The switch control circuit 40 may control conduction or non-conduction between the driving circuit 10 and the first connection node P1 in response to the light-emitting control signal.

For example, the switch control circuit 40 may control conduction between the driving circuit 10 and the first connection node P1 when the electric potential of the light-emitting control signal is the first electric potential, such that the driving circuit 10 outputs the driving current generated per se to the first connection node P1 by the switch control circuit 40.

The switch control circuit 40 is disposed to avoid that the driving current is incorrectly output to the light-emitting element L1 when a signal supplied by any signal terminal other than the light-emitting control signal terminal EM is unstable. That is, it can be ensured that the driving current is output to the light-emitting element L1 only when the electric potential of the light-emitting control signal is an effective electric potential. The reliability that the pixel circuit drives the light-emitting element L1 to emit light is further improved.

Figure 6:
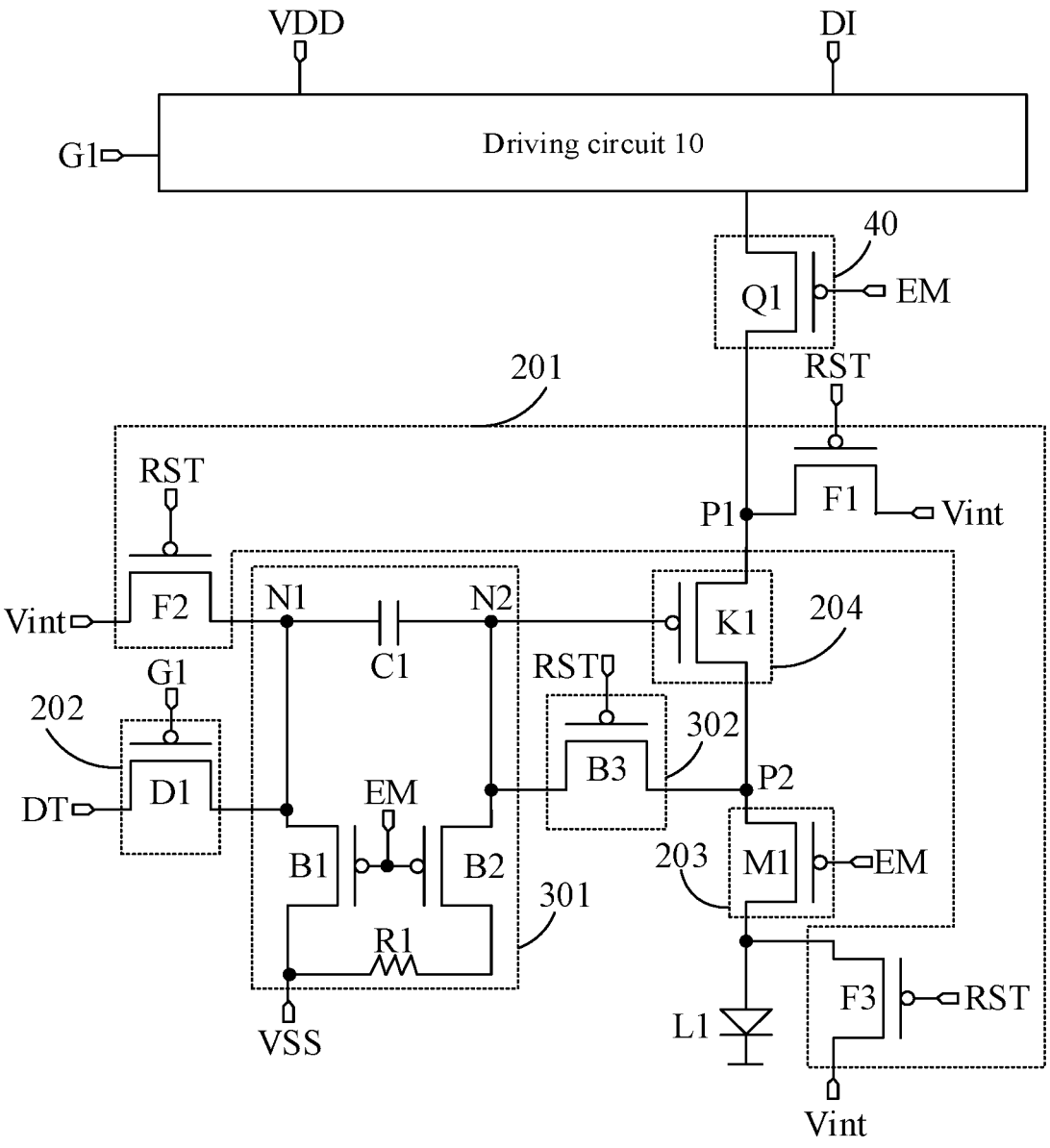
FIG. 6 is a schematic diagram of still another pixel circuit according to an embodiment of the present disclosure.

FIG. 6 is a schematic diagram of still another pixel circuit according to an embodiment of the present disclosure. As shown in FIG. 6, the switch control circuit 40 may include: a switch control transistor Q1.

A gate of the switch control transistor Q1 may be coupled to the light-emitting control signal terminal EM, a first electrode of the switch control transistor Q1 may be coupled to the driving circuit, and a second electrode of the switch control transistor Q1 may be coupled to the first connection node P1.

Figure 7:
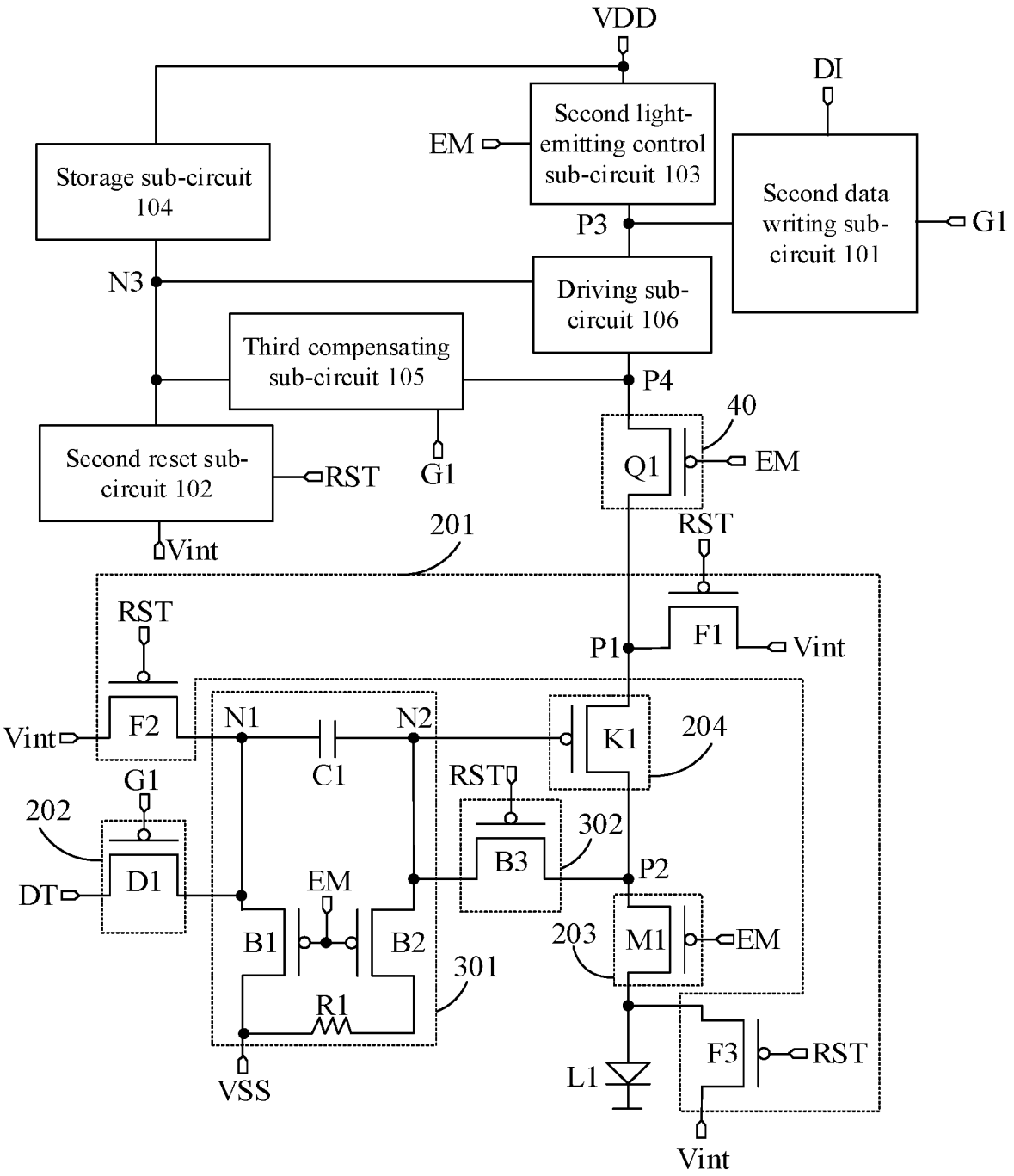
FIG. 7 is a schematic diagram of still another pixel circuit according to an embodiment of the present disclosure.

FIG. 7 is a schematic diagram of still another pixel circuit according to an embodiment of the present disclosure. As shown in FIG. 7, the driving circuit 10 may include: a second data writing sub-circuit 101, a second reset sub-circuit 102, a second light-emitting control sub-circuit 103, a storage sub-circuit 104, a third compensating sub-circuit 105, and a driving sub-circuit 106.

The second data writing sub-circuit 101 may be coupled to the gate signal terminal G1, the first data signal terminal D1, and a third connection node P3, respectively. The second data writing sub-circuit 101 may output the first data signal to the third connection node P3 in response to the gate driving signal.

For example, the second data writing sub-circuit 101 may output the first data signal to the third connection node P3 when the electric potential of the gate driving signal is the first electric potential.

The second reset sub-circuit 102 may be coupled to the reset signal terminal RST, the second power source terminal Vint, and a third control node N3, respectively. The second reset sub-circuit 102 may output the second power source signal to the third control node N3 in response to the reset signal.

For example, the second reset sub-circuit 102 may output the second power source signal at the second electric potential to the third control node N3 when the electric potential of the reset signal is the first electric potential, so as to reset the third control node N3.

The second light-emitting control sub-circuit 103 may be coupled to the light-emitting control signal terminal EM, the first power source terminal VDD, and the third connection node P3, respectively. The second light-emitting control sub-circuit 103 may output the first power source signal to the third connection node P3 in response to the light-emitting control signal.

For example, the second light-emitting control sub-circuit 103 may output the first power source signal at the first electric potential to the third connection node P3 when the electric potential of the light-emitting control signal is the first electric potential, so as to charge the third connection node P3.

The storage sub-circuit 104 may be coupled to the third control node N3 and the first power source terminal VDD, respectively. The storage sub-circuit 104 may control an electric potential of the third control node N3.

For example, the storage sub-circuit 104 may be configured to store the electric potential output to the third control node N3.

The third compensating sub-circuit 105 may be coupled to the gate signal terminal G1, the first connection node P1, and the third control node N3, respectively. The third compensating sub-circuit 105 may adjust the electric potential of the third control node N3 according to the electric potential of the first connection node P1 in response to the gate driving signal.

For example, the third compensating sub-circuit 105 may adjust the electric potential of the third control node N3 based on the electric potential of the first connection node P1 when the electric potential of the gate driving signal is the first electric potential.

It should be noted that, referring to FIG. 7, if the pixel circuit further includes the switch control circuit 40 connected in series between the driving circuit 10 and the first connection node P1, a connection point between the driving circuit 10 and the switch control circuit 40 may be denoted as a fourth connection node P4. Accordingly, referring to FIG. 7, the third compensating sub-circuit 105 is connected to the fourth connection node P4, and adjusts the electric potential of the third control node N3 according to the electric potential of the fourth connection node P4. Moreover, the switch control circuit 40 is also configured to control conduction or non-conduction between the fourth connection node P4 and the first connection node P1 in response to the light-emitting control signal.

The driving sub-circuit 106 may be coupled to the third control node N3, the third connection node P3, and the first connection node P1, respectively. The driving sub-circuit 106 may output the driving current to the first connection node P1 in response to the electric potential of the third control node N3 and an electric potential of the third connection node P3.

For example, when the electric potential of the third control node N3 is the first electric potential, the driving sub-circuit 106 may output the driving current to the first connection node P1 based on the electric potential of the third control node N3 and the electric potential of the third connection node P3. Similarly, if referring to FIG. 7, the pixel circuit further includes the switch control circuit 40, then the driving sub-circuit 106 is connected to the fourth connection node P4.

Figure 8:
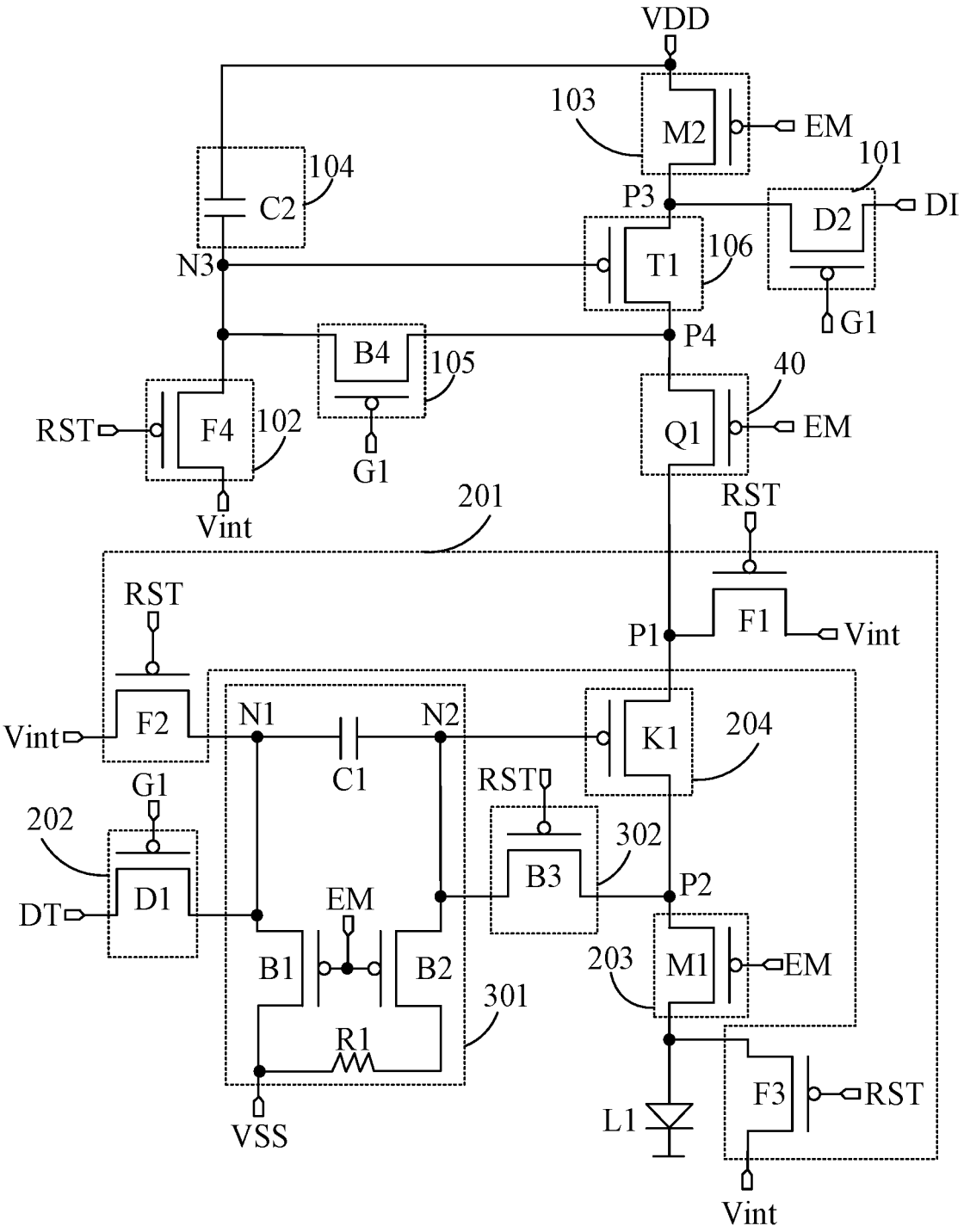
FIG. 8 is a schematic diagram of still another pixel circuit according to an embodiment of the present disclosure.

FIG. 8 is a schematic diagram of still another pixel circuit according to an embodiment of the present disclosure. As shown in FIG. 8, the second data writing sub-circuit 101 may include: a second data writing transistor D2. The second reset sub-circuit 102 may include: a fourth reset transistor F4. The second light-emitting control sub-circuit 103 may include: a second light-emitting control transistor M2. The storage sub-circuit 104 may include a storage capacitor C2. The third compensating sub-circuit 105 may include: a fourth compensating transistor B4. The driving sub-circuit 106 may include a driving transistor T1.

A gate of the second data writing transistor D2 may be coupled to the gate signal terminal G1. A first electrode of the second data writing transistor D2 may be coupled to the first data signal terminal DI, and a second electrode of the second data writing transistor D2 may be coupled to the third connection node P3.

A gate of the fourth reset transistor F4 may be coupled to the reset signal terminal RST, a first electrode of the fourth reset transistor F4 may be coupled to the second power source terminal Vint, and a second electrode of the fourth reset transistor F4 may be coupled to the third control node N3.

A gate of the second light-emitting control transistor M2 may be coupled to the light-emitting control signal terminal EM, a first electrode of the second light-emitting control transistor M2 may be coupled to the first power source terminal VDD, and a second electrode of the second light-emitting control transistor M2 may be coupled to the third connection node P3.

One terminal of the storage capacitor C2 may be coupled to the third control node N3, and the other terminal of the storage capacitor C2 may be coupled to the first power source terminal VDD.

A gate of the fourth compensating transistor B4 may be coupled to the gate signal terminal G1, a first electrode of the fourth compensating transistor B4 may be coupled to the first connection node P1, and a second electrode of the fourth compensating transistor B4 may be coupled to the third control node N3.

As described above for the third compensating sub-circuit 105, if the switch control transistor Q1 is included, then referring to FIG. 8, the first electrode of the fourth compensating transistor B4 is coupled to the fourth connection node P4.

A gate of the driving transistor T1 may be coupled to the third control node N3, a first electrode of the driving transistor T1 may be coupled to the third connection node P3, and a second electrode of the driving transistor T1 may be coupled to the first connection node P1.

As described above for the driving sub-circuit 106, if the switch control transistor Q1 is included, then referring to FIG. 8, the second electrode of the driving transistor T1 is coupled to the fourth connection node P4.

It should be noted that the coupling described in the embodiments of the present disclosure may include: electrical connection between two terminals or direct connection between two terminals (for example, the connection is established between the two terminals by a signal line). Moreover, in the above embodiments, the case that each transistor is a P-type transistor, and the first electric potential is a low potential relative to the second electric potential is taken as an example for illustration. Alternatively, each transistor may also be an N-type transistor. When each transistor is the N-type transistor, the first electric potential may be a high potential relative to the second electric potential.

It should also be noted that, in the embodiment of the present disclosure, in addition to a 6T1C structure (that is, six transistors and one capacitor) shown in FIG. 8, the driving circuit 10 may also be a structure including other numbers of transistors, such as a 2T1C structure or a 4T1C structure, which is not limited in the embodiment of the present disclosure.

In summary, the embodiment of the present disclosure provides a pixel circuit. The pixel circuit includes a compensating circuit. The compensating circuit can adjust an electric potential of a second control node (that is, a gate of a transistor controlling conduction or non-conduction between a first connection node and a second connection node) according to an electric potential of a first control node, and adjust an electric potential of the second control node according to an electric potential of the second connection node (that is, a second electrode of a transistor controlling conduction or non-conduction between the first connection node and the second connection node). When the pixel circuit is driven, electric potential of each control signal can be controlled, such that influence of a threshold voltage of a transistor on an electric potential finally output to the second control node is relatively small, that is, influence of drifting of a threshold voltage shift on display uniformity is reduced. The display device according to the present disclosure achieves a good display effect.

FIG. 9 is a flow chart of a method for driving a pixel circuit according to an embodiment of the present disclosure. The method is applicable to the pixel circuit shown in any of FIGS. 2 to 8. As shown in FIG. 9, the method may include the following steps.

In step 901, a reset stage, in which an electric potential of a reset signal supplied by the reset signal terminal is a first electric potential; the light-emitting control circuit outputs the second power source signal from the second power source terminal to the first connection node and the first control node in response to the reset signal; the compensating circuit adjusts the electric potential of the second control node according to the electric potential of the first control node; the light-emitting control circuit further controls conduction between the first connection node and the second connection node in response to the electric potential of the second control node; and the compensating circuit further adjusts the electric potential of the second control node according to the electric potential of the second connection node in response to the reset signal.

Optionally, an electric potential of the second power source signal may be a second electric potential, which may be a high potential relative to the first electric potential.

In step 902, a data writing stage, in which an electric potential of the gate driving signal supplied by the gate signal terminal is the first electric potential; the light-emitting control circuit outputs the second data signal from the second data signal terminal to the first control node in response to the gate driving signal; and the compensating circuit adjusts the electric potential of the second control node according to the electric potential of the first control node.

In step 903, a light-emitting control stage, in which the driving circuit outputs the driving current to the first connection node in response to the first power source signal from the first power source terminal, the gate driving signal, and the first data signal from the first data signal terminal; an electric potential of the light-emitting control signal supplied by the light-emitting control signal terminal is the first electric potential; the compensating circuit adjusts the electric potential of the second control node according to the electric potential of the first control node and the third power source signal from the third power source terminal in response to the light-emitting control signal; and the light-emitting control circuit controls conduction between the first connection node and the second connection node in response to the electric potential of the second control node, and controls conduction between the second connection node and the light-emitting element in response to the light-emitting control signal.

Optionally, an electric potential of the third power source signal may be a third electric potential, which may be a low potential relative to the second electric potential.

In summary, an embodiment of the present disclosure provides a method for driving a pixel circuit. In this method, a compensating circuit can adjust an electric potential of a second control node (that is, a gate of a transistor controlling conduction or non-conduction between a first connection node and a second connection node) according to an electric potential of a first control node, and adjust an electric potential of the second control node according to an electric potential of the second connection node (that is, a second electrode of a transistor controlling conduction or non-conduction between the first connection node and the second connection node). When the pixel circuit is driven, electric potential of each control signal can be controlled, such that influence of a threshold voltage of a transistor on an electric potential finally output to the second control node is relatively small, that is, influence of drifting of a threshold voltage shift on display uniformity is reduced. The display device according to the present disclosure achieves a good display effect.

By taking the following case as an example, in which the circuit formed by the pixel circuit 01, the light-emitting control circuit 20, and the compensating circuit 30 shown in FIG. 8 is a time period control circuit 100, each transistor included in the pixel circuit is a P-type transistor, the first electric potential (that is, the effective electric potential) is a low potential relative to the second electric potential (that is, the ineffective electric potential), and the third electric potential is a low potential relative to the first electric potential for illustration, a driving principle of the pixel circuit according to the embodiment of the present disclosure is described in detail.

FIG. 10 is a timing diagram of each signal terminal in a pixel circuit according to an embodiment of the present disclosure. As shown in FIG. 10, in a reset stage t1, the electric potential of the reset signal supplied by the reset signal terminal RST is the first electric potential, the first reset transistor F1, the second reset transistor F2, the third reset transistor F3, the fourth reset transistor F4, and the third compensating transistor B3 are all turned on. The second power source terminal Vint may output the second power source signal at the second electric potential to the first connection node P1 through the first reset transistor F1, so as to reset the first connection node P1. The second power source terminal Vint may output the second power source signal at the second electric potential to the first control node N1 through the second reset transistor F2, so as to reset the first control node N1. The second power source terminal Vint may output the second power source signal at the second electric potential to the light-emitting element L1 through the third reset transistor F3, so as to reset the light-emitting element L1. Besides, the second power source terminal Vint may output the second power source signal at the second electric potential to the third control node N3 through the fourth reset transistor F4, so as to reset the third control node N3. The storage capacitor C2 may store the electric potential of the third control node N3.

Figure 11:
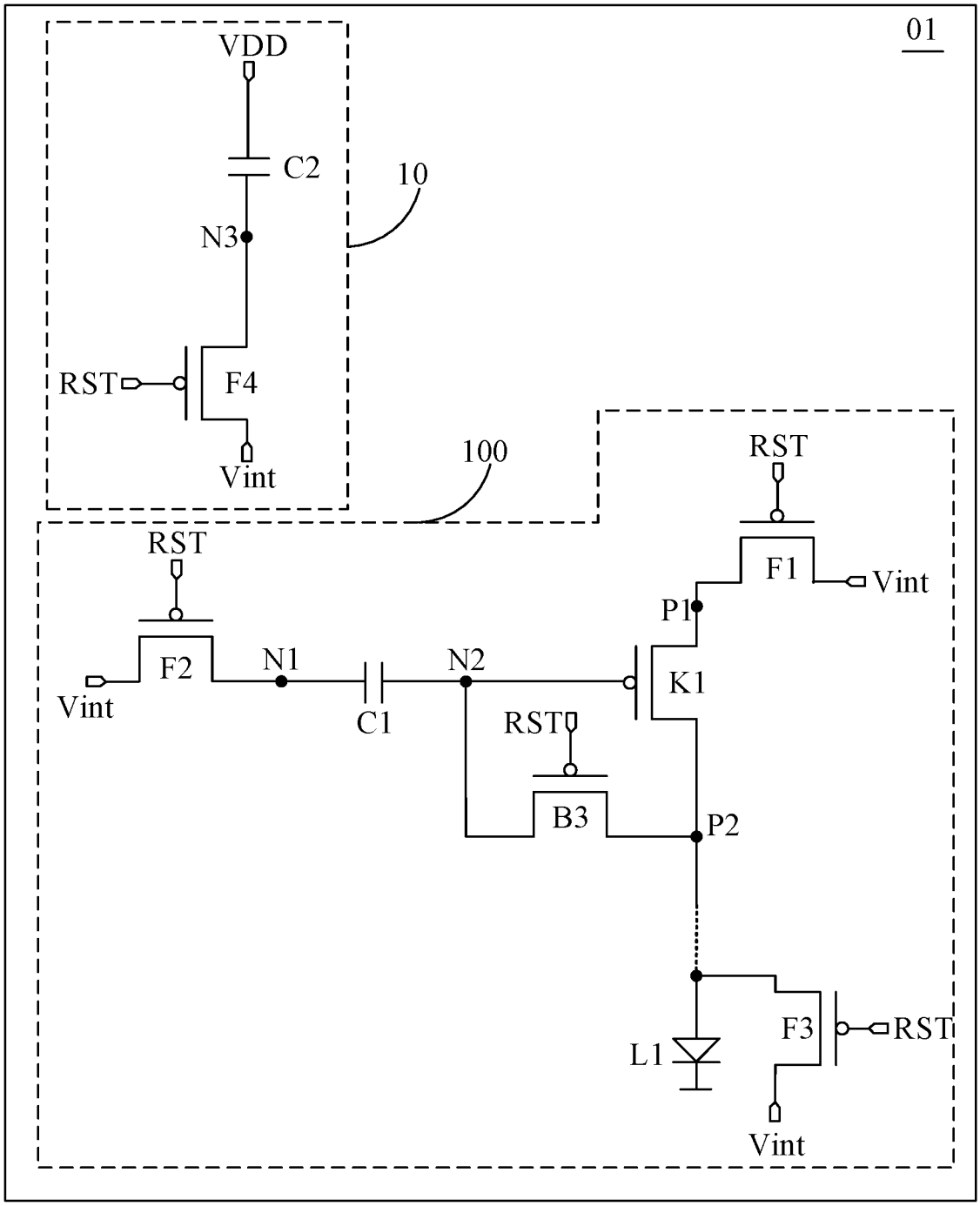
FIG. 11 is an equivalent circuit diagram of a pixel circuit in a reset stage according to an embodiment of the present disclosure.

In addition, due to a coupling effect of the compensating capacitor C1, the electric potential of the second control node N2 also becomes the second electric potential. Accordingly, the switch transistor K1 is turned on, and controls conduction between the first connection node P1 and the second connection node P2. At this time, the third compensating transistor B3 may adjust the electric potential of the second control node N2 based on the electric potential of the second connection node P2, thereby writing the second power source signal and a threshold voltage of the switch transistor K1 to the second control node N2. In addition, referring to FIG. 10, in the reset stage t1, the electric potential of the gate driving signal supplied by the gate signal terminal G1 and the electric potential of the light-emitting control signal supplied by the light-emitting control signal terminal EM are both the second electric potential, and all transistors except the above turned-on transistors are turned off. An equivalent circuit diagram of the pixel circuit in the reset stage t1 may refer to FIG. 11 (a dotted line in the figure refers to disconnection).

Exemplarily, it is assumed that that the electric potential of the second power source signal is Vint0, and the threshold voltage of the switch transistor K1 is Vth1. Then referring to Table 1 below, in the reset stage t1, the electric potential of the first control node N1 is Vint0; the electric potential of the second control node N2 is Vint0+Vth1; and the electric potential of the third control node N3 is Vint0.

TABLE 1

| | Reset stage t1 | Data writing stage t2 | Light-emitting stage t3 |
|---|---|---|---|
| N1 | Vint0 | VdataT | 0 |
| N2 | Vint0 + Vth1 | VdataT + Vth1 | (VdataT + Vth1) * $e^{(-t/rl*cl)}$ |
| N3 | Vint0 | VdataI + Vth2 | VdataI + Vth2 |

With continued reference to FIG. 10, in the data writing stage t2, the electric potential of the gate signal supplied by the gate driving signal terminal G1 is the first electric potential, the first data signal terminal DI supplies the first data signal, and the second data signal terminal DT supplies the second data signal (the first data signal and the second data signal are not shown in FIG. 10). The first data writing transistor D1, the second data writing transistor D2, and the fourth compensating transistor B4 are all turned on. The first data signal terminal DI may output the first data signal to the third connection node P3 through the second data writing transistor D2, so as to charge the third connection node P3. The second data signal terminal DT may output the second data signal to the first control node N1 through the first data writing transistor D1, so as to charge the first control node N1. In addition, due to the coupling effect of the compensating capacitor C1, the electric potential of the second control node N2 becomes a sum of the second data signal and the threshold voltage of the switch transistor K1.

In the reset stage t1, the third control node N3 is written with the second power source signal of the second electric potential, and the storage capacitor C2 stores the electric potential of the third control node N3. Therefore, in the data writing stage t2, the driving transistor T1 may be turned on. At this time, the electric potential of the third connection node P3 is output to the fourth connection node P4 through the driving transistor T1, and the fourth compensating transistor B4 adjusts the electric potential of the third control node N3 according to the electric potential of the fourth connection node P4. Thus, the first data signal and a threshold voltage of the driving transistor T1 are written to the third control node N3, and the storage capacitor C2 continues to store the electric potential of the third control node N3.

Figure 12:
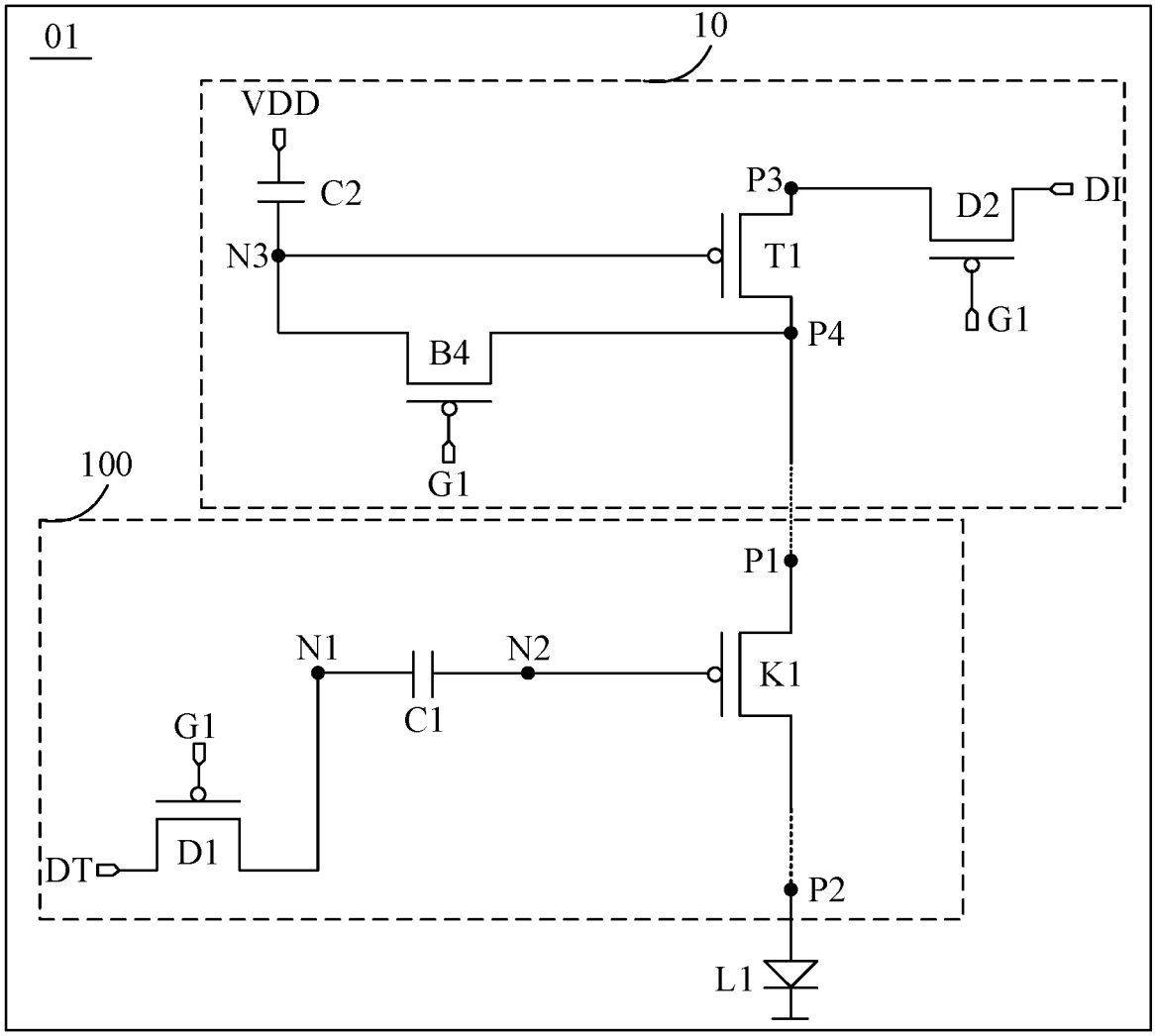
FIG. 12 is an equivalent circuit diagram of a pixel circuit in a data writing stage according to an embodiment of the present disclosure.

In addition, referring to FIG. 10, in the data writing stage t2, the electric potential of the reset signal supplied by the reset signal terminal RST and the electric potential of the light-emitting control signal supplied by the light-emitting control signal terminal EM are both the second electric potential, and all transistors except the transistors turned on in the data writing stage t2 are turned off. An equivalent circuit diagram of the pixel circuit in the data writing stage t2 may refer to FIG. 12 (a dotted line in the figure refers to disconnection).

Exemplarily, it is assumed that that the electric potential of the first data signal is Vdata1, the electric potential of the second data signal is VdataT, and the threshold voltage of the driving transistor T1 is Vth2. Then, referring to Table 1, in the data writing stage t2, the electric potential of the first control node N1 becomes VdataT; the electric potential of the second control node N2 is VdataT+Vth1; and the electric potential of the third control node N3 is VdataI+Vth2.

With continued reference to FIG. 10, in the light-emitting stage t3, the electric potential of the light-emitting control signal supplied by the light-emitting control signal terminal EM is the first electric potential, and the first light-emitting control transistor M1, the second light-emitting control transistor M2, the first compensating transistor B1, the second compensating transistor B2, and the switch control transistor Q1 are all turned on. In addition, due to a storage effect of the storage capacitor C2, in the light-emitting period t3, the electric potential of the third control node N3 is a sum of the first data signal and the threshold voltage of the driving transistor T1, and the driving transistor T1 is turned on. The first power source terminal VDD outputs the first power source signal at the first electric potential to the third connection node P3 through the second light-emitting control transistor M3. Accordingly, the driving transistor T1 outputs the driving current to the four connection node P4 according to the first power source signal and the electric potential of the third control node N3. The electric potential of the fourth connection node P4 may be continuously output to the first connection node P1 through the switch control transistor Q1.

In addition, in the light-emitting stage t3, conduction between the second connection node P2 and the light-emitting element L1 is established. The third power source terminal VSS may output the third power source signal of the third electric potential to the first control node N1 through an RC discharge circuit formed by the first compensating transistor B1, the second compensating transistor B2, the compensating resistor R1, and the compensating capacitor C1, to pull down the electric potential of the first control node N1. It is assumed that that the third power source terminal VSS is a ground terminal, then the first control node N1 is grounded. Under the coupling effect of the compensating capacitor C1, the electric potential of the second control node N2 begins to decrease until the switch transistor K1 is turned on. When the switch transistor K1 is turned on, that is, conduction between the first connection node P1 and the second connection node P2 may be controlled. The driving current may be further output to the second connection node P2 through the switch transistor K1, and then output to the light-emitting element L1 through the first light-emitting control transistor M1, thereby driving the light-emitting element L1 to emit light. This stage continues until the electric potential of the light-emitting control signal supplied by the light-emitting control signal terminal EM jumps to the first electric potential.

Figure 13:
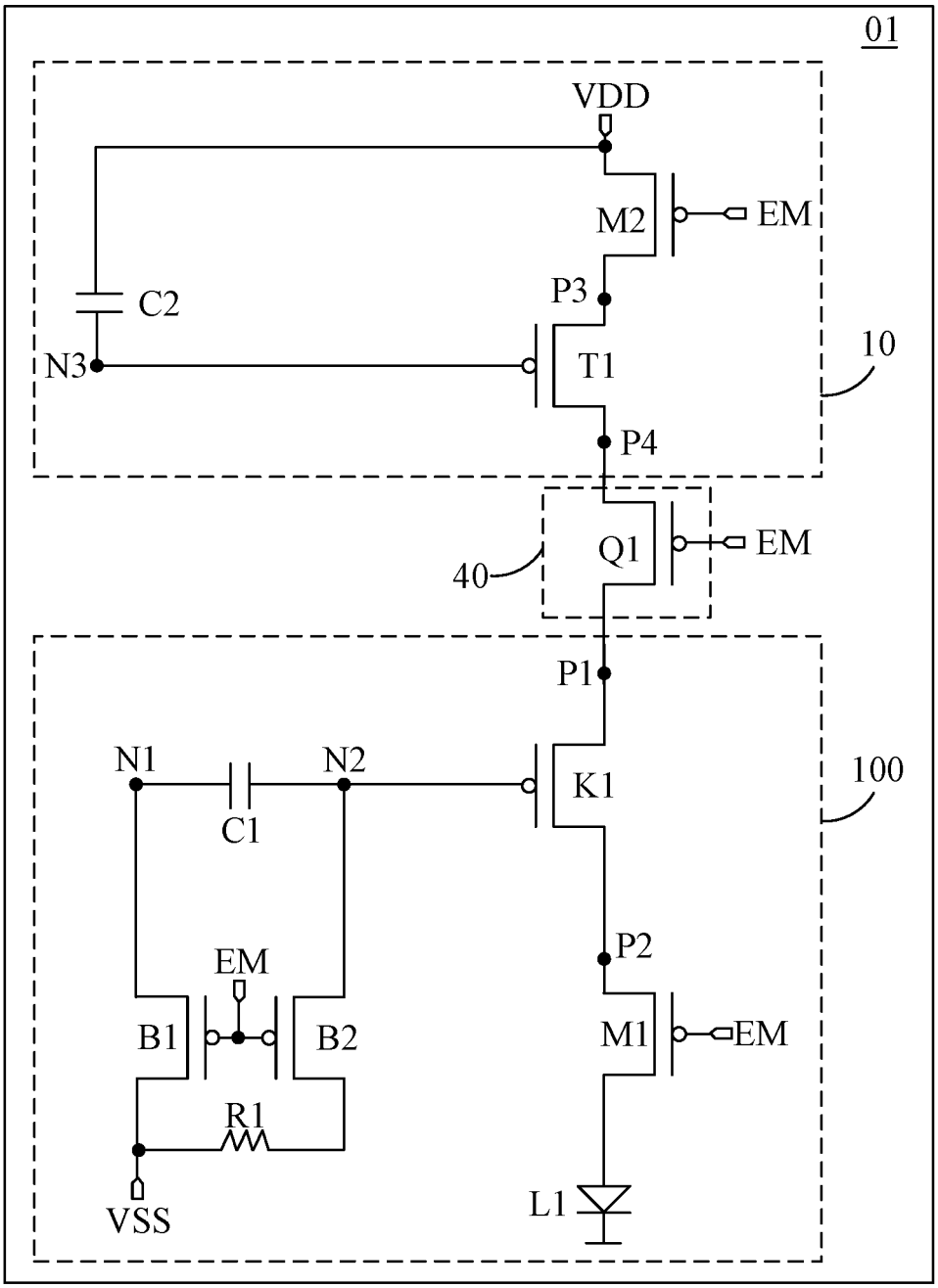
FIG. 13 is an equivalent circuit diagram of a pixel circuit in a light-emitting stage according to an embodiment of the present disclosure.

In addition, referring to FIG. 10, in the light-emitting stage t3, the electric potential of the gate driving signal supplied by the gate signal terminal G1 and the electric potential of the light-emitting control signal supplied by the light-emitting control signal terminal EM are both the second electric potential. All transistors except the transistors turned on in the light-emitting stage t3 are turned off. An equivalent circuit diagram of the pixel circuit in the light-emitting stage t3 may refer to FIG. 13.

Exemplarily, it is assumed that that the electric potential of the first power source signal is VDD1, the electric potential of the third power source signal is 0, the electric potential of the first data signal is VdataI, the electric potential of the second data signal is VdataT, the threshold voltage of the switch transistor K1 is Vth1, the threshold voltage of the driving transistor T1 is Vth2, a resistance value of the compensating resistor R1 is r1, and a capacitance value of the compensating capacitor C1 is c1. Then referring to Table 1 above, in the light-emitting stage t1, the electric potential of the first control node N1 becomes 0; the electric potential of the second control node N2 becomes $(\text{VdataT}+\text{Vth1})*e^{(-t/r1*c1)}$; and the electric potential of the third control node N3 is VdataI+Vth2.

In combination with the electric potential of each node, a compensating principle of the threshold voltage Vth1 of the driving transistor T1 is introduced as follows.

At first, if the electric potential of the gate of the driving transistor T1 (for example, the third control node N3) is denoted as Vg1, the source electrode of the driving transistor T1 (for example, the third connection node P3), and a gate-source voltage of the driving transistor T1 is denoted as Vgs1. Then Vgs1 according to the embodiment of the present disclosure may satisfy:

$$Vgs1=Vg1-Vs1=VDD-(V\,\text{data}I+Vth2) \quad \text{Formula (1).}$$

The driving current $I_{led}$ generated by the driving transistor T1 satisfies:

$$I_{led}=k*(Vgs1-Vth2)^2 \quad \text{Formula (2).}$$

By substituting Vgs1 calculated by Formula (1) into Formula (2), it can be concluded that the driving current $I_{led}$ finally output by the driving transistor T1 described in the embodiment of the present disclosure satisfies:

$$I_{led}=k*(Vgs1-Vth2)^2=k*(VDD1-V\text{data}I)^2 \quad \text{Formula (3).}$$

k is a characteristic of the driving transistor T1 per se, and is determined by a carrier mobility of the driving transistor T1, the capacitance of a gate insulating layer, and an aspect ratio. It can be seen from the above Formula (3) that when the light-emitting element L1 works normally, the magnitude of the driving current Led for driving the light-emitting element L1 is only related to the first power source signal supplied by the first power source terminal VDD and the first data signal supplied by the first data signal terminal DI and is unrelated to the threshold voltage of the driving transistor T1. Therefore, the driving current output to the light-emitting element L1 will not be affected by drifting of a threshold voltage of the driving transistor T1, which effectively ensures display uniformity.

It should be noted that if the light-emitting element L1 is a Micro LED, a light-emitting efficiency of the Micro LED changes significantly at a low current density. Therefore, the electric potential of the first data signal supplied by the first data signal terminal DI can be flexibly set. That is, VdataI is flexibly set, such that the Micro LED can work under a high current density, that is, in an area with stable light-emitting efficiency, which ensures display stability.

In combination with the electric potential of each node, a compensating principle of the threshold voltage Vth2 of the switch transistor K1 is introduced as follows.

In the embodiment of the present disclosure, the switch transistor K1 is turned on under a condition that the absolute value of a gate-source voltage difference is greater than or equal to an absolute value of the threshold voltage. It is assumed that for the switch transistor K1, a gate electric potential is denoted as Vg2, a source electrode electric potential is denoted as Vs2, and the gate-source voltage difference is denoted as Vgs2. Then the conduction condition is $|\text{Vgs2}|\geq|\text{Vth1}|$. Under the action of the RC discharge circuit, Vgs2 may satisfy:

$$Vgs2=Vg2-Vs2=(V\,dataT+Vth1)e^{(-t/r1*c1)}-Vs2 \quad \text{Formula (4);}$$

wherein t refers to discharge time. By combining the above Formula (4) with |Vgs1|≥|Vth1|, Formula (5) can be obtained:

$Vs2-(V\,dataT+Vth1)e^{(-t/r1*c1)}+Vth1\geq 0$ Formula (5). It is concluded that when the electric potential of the second control node N2 described in the embodiment of the present disclosure satisfies the following condition, the switch transistor K1 is turned on:

$$Vs2-V\,dataT*e^{(-t/r1*c1)}+(1-e^{(-t/r1*c1)})*Vth1\geq 0 \quad \text{Formula (6).}$$

According to the above Formula (6), it can be seen that after the threshold voltage Vth1 of the switch transistor K1 is compensated, a coefficient value becomes $1-e^{(-t/r1*c1)}$. If the threshold voltage of the switch transistor K1 is not compensated, the coefficient value is $e^{(-t/r1*c1)}$.

Figure 14:
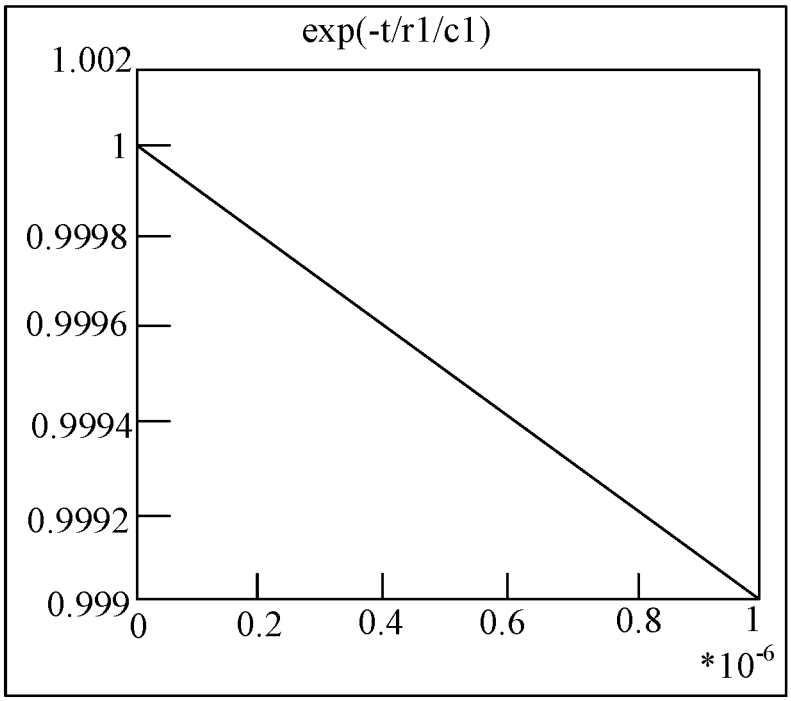
FIG. 14 is a schematic diagram of a coefficient value of an electric potential of a second control node in the related art.
Figure 15:
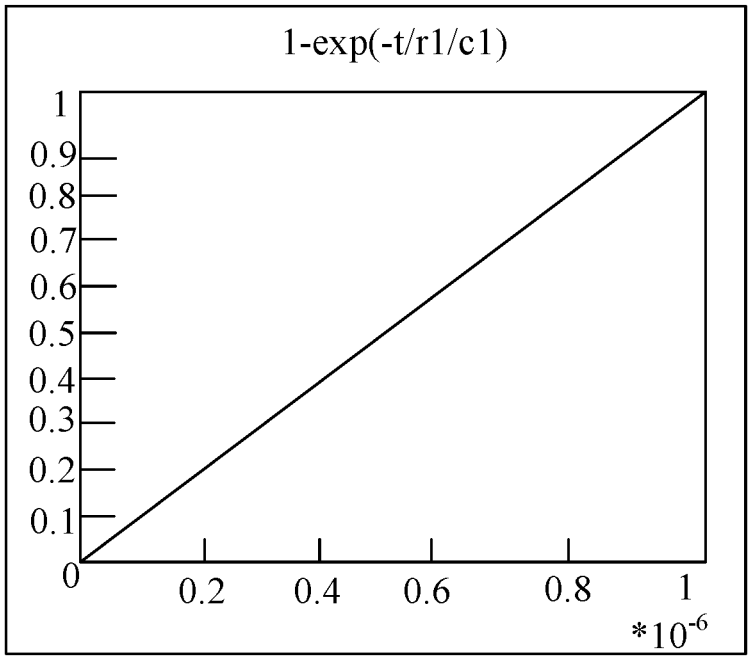
FIG. 15 is a schematic diagram of a coefficient value of an electric potential of a second control node according to an embodiment of the present disclosure.

FIG. 14 shows a schematic diagram of the coefficient before compensating. FIG. 15 shows a schematic diagram of the coefficient after compensating. A horizontal axis represents time, and a vertical axis represents the obtained coefficient value. By comparing FIG. 14 and FIG. 15, it can be seen that the coefficient value before compensating for the threshold voltage of the switch transistor K1 is about 1, and the coefficient value after compensating is about 0.001. Correspondingly, the impact of drifting of the threshold voltage of the switch transistor K1 on an emission time of the light-emitting element L1 is effectively reduced. By compensating the threshold voltage of the switch transistor K1 and the threshold voltage of the driving transistor T1, the impact of drifting of the threshold voltage on display uniformity is effectively reduced, a mura phenomenon of the display device is greatly reduced, and the display effect of the display device is improved.

Figure 16:
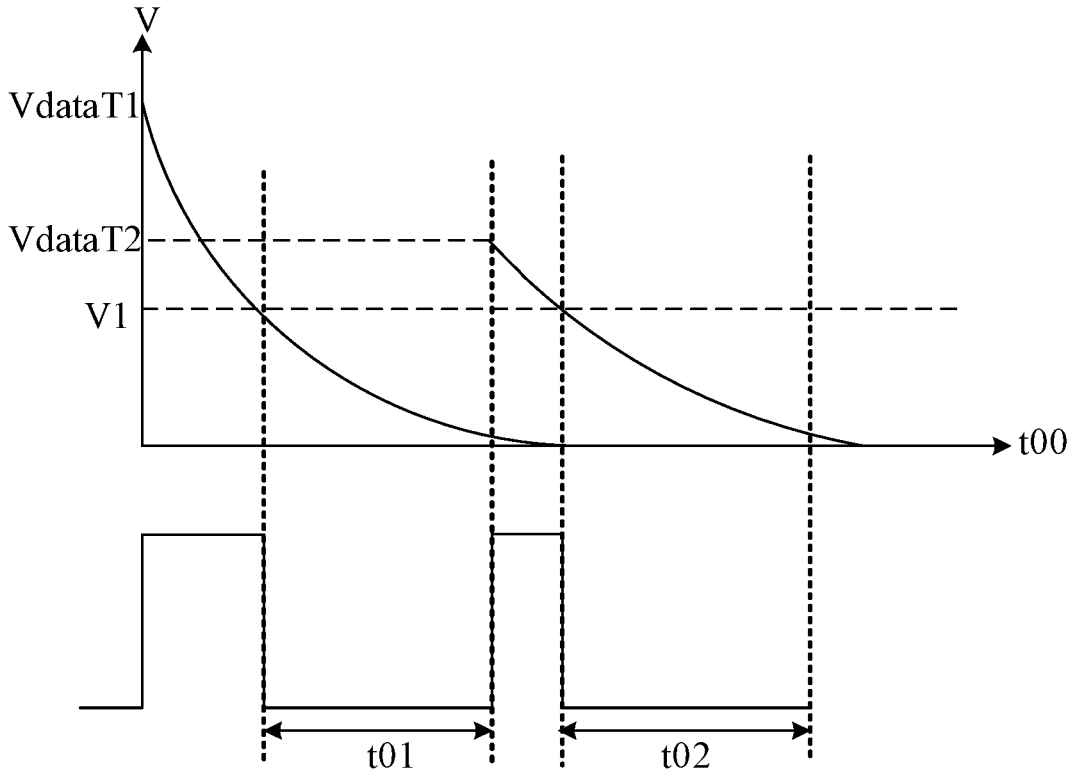
FIG. 16 is a schematic diagram of a relationship between an emission time and an electric potential of a data signal according to an embodiment of the present disclosure.

The following embodiment introduces an impact of the second data signal on the emission time, that is, a principle of controlling the emission time of the light-emitting element L1: FIG. 16 shows a relationship between the emission time and the electric potential of the second data signal supplied by the second data signal terminal DT. The horizontal axis may refer to time t00, and the vertical axis may refer to electric potential (V). Referring to FIG. 16, it can be seen that the greater the electric potential of the second data signal (for example, VdataT1) is, the longer the time required for the electric potential of the second control node N2 to drop to the electric potential V1 capable of turning on the switch transistor K1 is. The greater the electric potential of the second data signal (for example, VdataT2) is, the shorter the time required for the electric potential of the second control node N2 to drop to the electric potential V1 capable of turning on the switch transistor K1 is.

Correspondingly, FIG. 16 also shows an emission time timing corresponding to the light-emitting element L1. Emission time1 t01 corresponding to the second data signal VdataT1 with a larger electric potential is less than emission time2 t02 corresponding to the second data signal VdataT2 with a smaller electric potential. Since a light-emitting brightness of the light-emitting element L1 has a linear relationship with the emission time in each frame of a display stage, the light-emitting brightness corresponding to the light-emitting element L1 is also different under different emission time. That is, a gray scale is also flexibly adjusted y controlling the emission time.

Figure 17:
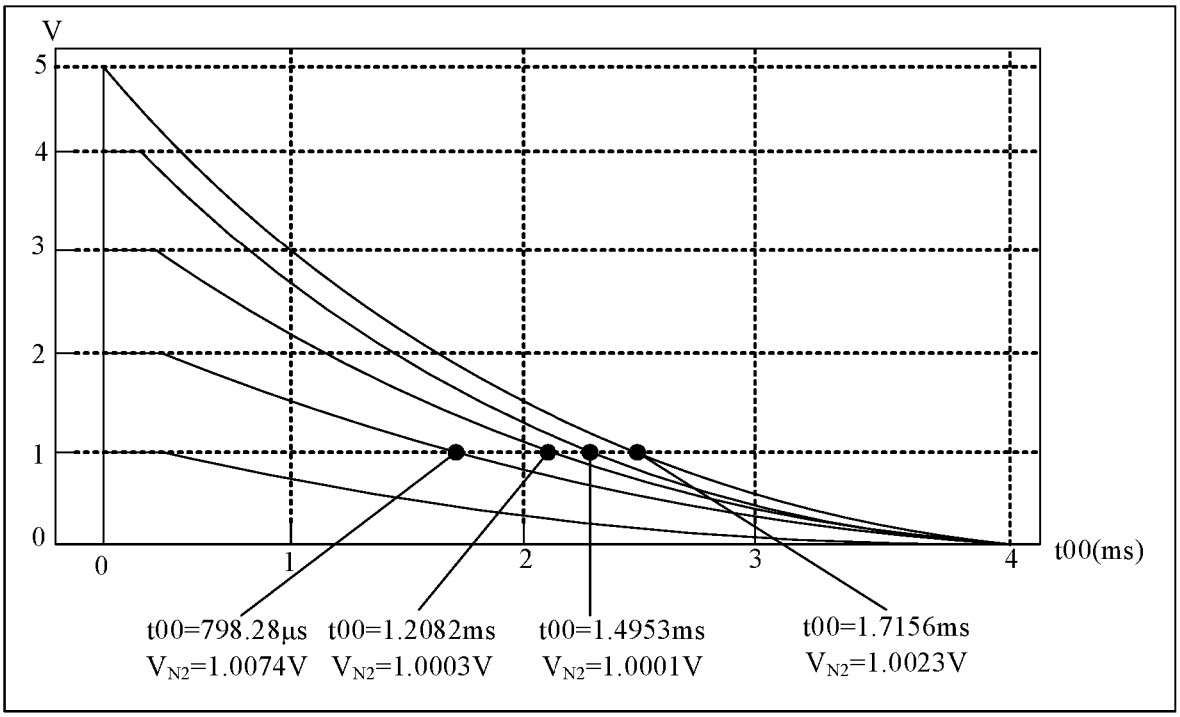
FIG. 17 is a simulated diagram of a relationship between an emission time and an electric potential of a data signal according to an embodiment of the present disclosure.

For example, FIG. 17 also shows a simulation result of different electric potentials of the second data signal and the emission time, in which the horizontal axis refers to time t00 (ms), and the vertical axis refers to electric potential (V). It is assumed that that the electric potential VN2 of the second control node N2 driving the switch transistor K1 to be turned on is about 1V, referring to FIG. 17, it can be seen that the time required for the second data signal of different sizes to drop to about 1V is different. For example, the required time t00 from 2V to about 1V is 798.28 microseconds (μs); the time t00 from 3V to about 1V is 1.2082 ms; the time t00 from 4V to about 1V is 1.4953 ms; and the time t00 from 5V to about 1V is 1.7156 ms. The longer the time required to drop to about 1V is, the correspondingly shorter the emission time of the light-emitting element L1 is.

Optionally, the electric potential VdataT of the second data signal and the electric potential $V_{N2}$ of the second control node N2 satisfy:

$$V_{N2}=(V\,dataT-V\,int\,0)*e^{(-t/r1*c1)} \quad \text{Formula (7).}$$

According to Formula (7), it can be deduced that the emission time t00 of the light-emitting element L1 may satisfy:

$$t00=r1*c1*\ln[(V\,dataT-V\,int\,0)/V_{N2}] \quad \text{Formula (8).}$$

Through the dual control based on the driving current and the emission time, the display uniformity can be effectively ensured.

In summary, an embodiment of the present disclosure provides a method for driving a pixel circuit. In the method, a compensating circuit can adjust an electric potential of a second control node (that is, a gate of a transistor controlling conduction or non-conduction between a first connection node and a second connection node) based on an electric potential of a first control node, and adjust an electric potential of the second control node based on an electric potential of the second connection node (that is, a second electrode of a transistor controlling conduction or non-conduction between the first connection node and the second connection node). When the pixel circuit is driven, electric potential of each control signal can be controlled, such that influence of a threshold voltage of a transistor on an electric potential finally output to the second control node is relatively small, that is, influence of drifting of a threshold voltage on display uniformity is reduced. The display device according to the present disclosure achieves a good display effect.

Figure 18:
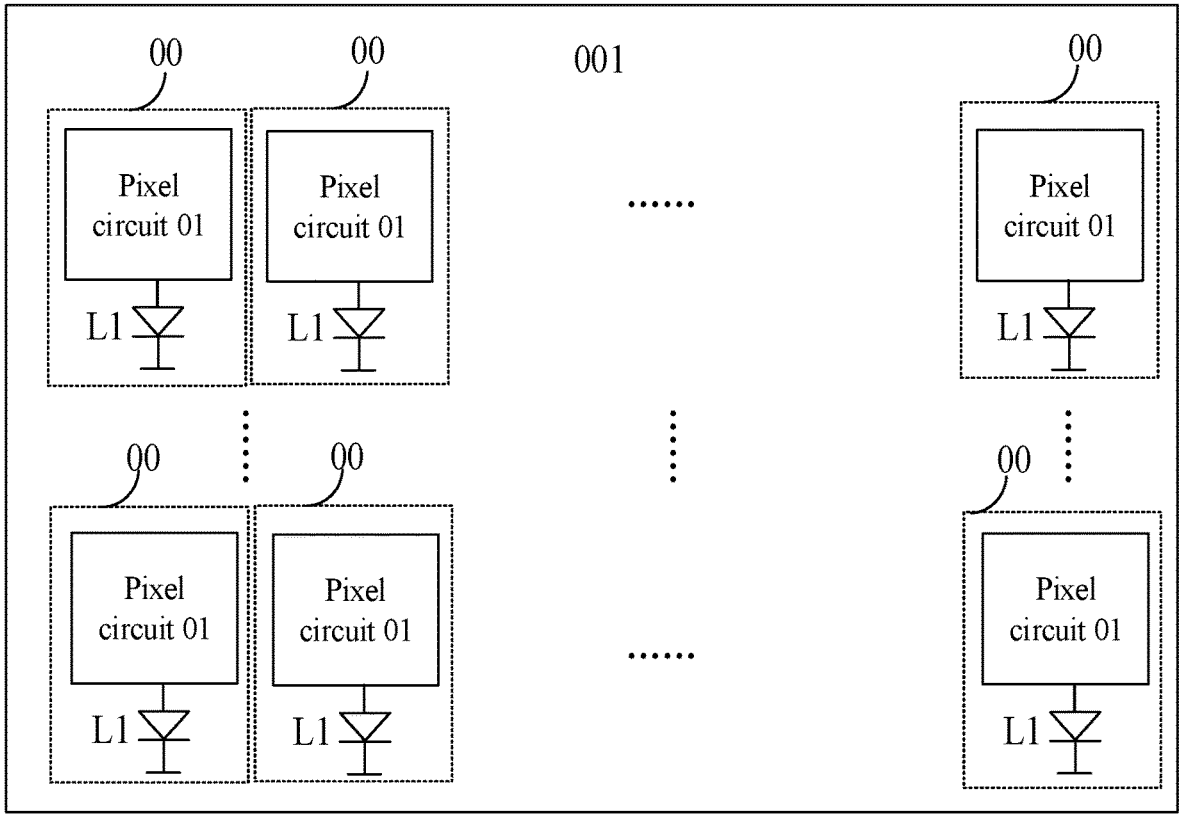
FIG. 18 is a schematic structural diagram of a display substrate according to an embodiment of the present disclosure.

Optionally, FIG. 18 is a schematic diagram of a display substrate according to an embodiment of the present disclosure. As shown in FIG. 18, the display substrate 001 may include: a plurality of pixel units 00. In the plurality of pixel units 00, each pixel unit 00 may include a light-emitting element L1, and at least one pixel unit 01 may include the pixel circuit 01 as shown in any one of FIGS. 2 to 8. For example, each pixel unit 00 included in the display substrate 001 shown in FIG. 18 includes the pixel circuit 01 shown in any one of FIGS. 2 to 8.

Optionally, the light-emitting element may include: a Micro LED.

Figure 19:
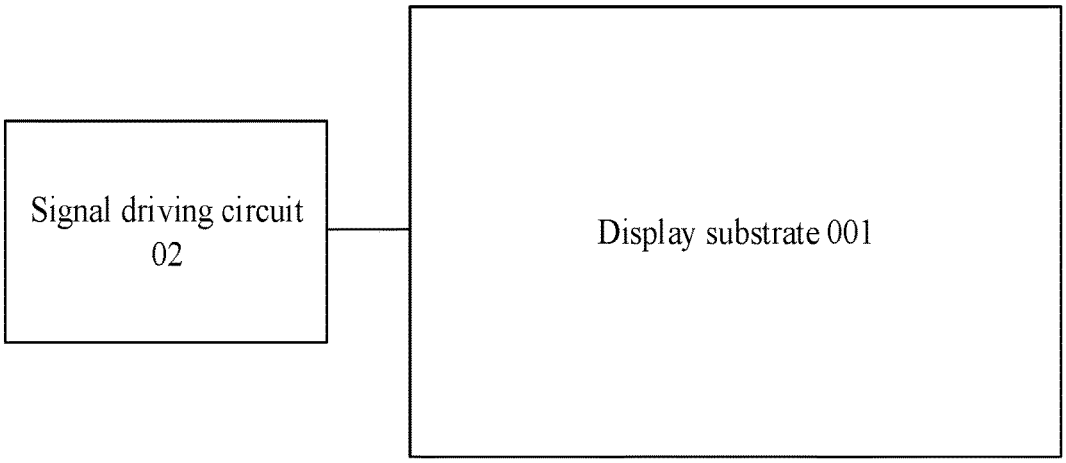
FIG. 19 is a schematic structural diagram of a display device according to an embodiment of the present disclosure.

FIG. 19 is a schematic diagram of a display device according to an embodiment of the present disclosure. As shown in FIG. 19, the display device may include: a signal driving circuit 02, and the display substrate 001 as shown in FIG. 18.

The signal driving circuit 02 may be coupled to each signal terminal in the pixel circuit 01 included in the display substrate 001, and the signal driving circuit 02 may be configured to supply signal to the each signal terminal.

For example, the signal driving circuit 02 may include a gate driving circuit and a source electrode driving circuit. The gate driving circuit may be connected to the gate signal terminal G1 in the pixel circuit 01 to supply a gate signal to the gate signal terminal G1. The source electrode driving circuit may be connected to the first data signal terminal DI and the second data signal terminal DT in the pixel circuit 01 to supply data signals to the first data signal terminal DI and the second data signal terminal DT.

It should be noted that the gate driving circuit may be connected to the gate signal terminal G1 by a gate line, and the source electrode driving circuit may be connected to the data signal terminals DI and DT by data signal lines. Moreover, the gate signal terminals G1 included in the pixel circuits in the same row may be connected to the same gate line. The first data signal terminals DI included in the pixel circuits in the same column may be connected to the same first data line. The second data signal terminals DT included in the pixel circuits in the same column may be connected to the same second data line.

In normal operation, the gate driving circuit may sequentially output the gate driving signal at the first electric potential to the gate signal terminals G1 connected to respective rows of pixel circuits by gate lines. In addition, the electric potential of the first data signal output by the source electrode driving circuit to the same first data line at different moments may be different. That is, the electric potentials of the first data signals output by the source electrode driving circuit to respective first data signal terminals DI included in respective pixel circuits in the same column but different rows by the same first data line may be different, which is similar for the second data signal terminal DT, and will not be repeated here.

By taking the two pixel circuits in the first row and first column and the second row and first column, and the same first data line connected to the first data signal terminals DI of the two pixel circuits referred to as a first data line as an example, it is assumed that in the data writing stage when the first row of pixel circuits are driven, the electric potential of the first data signal supplied by the source electrode driving circuit to the pixel circuit in the first row and first column by the first data line is VdataI1. In the data writing stage when the second row of pixel circuits are driven, the electric potential of the first data signal supplied by the source electrode driving circuit to the pixel circuit in the second row and first column by the first data line is VdataI2. Then VdataI1 and VdataI2 may be the same or different.

Optionally, the display device may be any product or component having a display function, such as a Micro LED display device, a liquid crystal panel, electronic paper, an OLED panel, an AMOLED panel, a mobile phone, a tablet computer, a television, a monitor, a notebook computer, a digital photo frame, and the like.

Those skilled in the art can clearly understand that, for the convenience and brevity of the description, the specific working processes of the pixel circuit, the display substrate and the display device described above can refer to the corresponding processes in the foregoing method embodiments, and details are not described herein again.

Described above are merely exemplary embodiments of the present disclosure, and are not intended to limit the present disclosure. Within the spirit and principles of the disclosure, any modifications, equivalent substitutions, improvements, and the like are within the protection scope of the present disclosure.

What is claimed is:

1. A pixel circuit, comprising: a driving circuit, a light-emitting control circuit, and a compensating circuit; wherein the driving circuit is coupled to a first power source terminal, a gate signal terminal, a first data signal terminal, and a first connection node, wherein the driving circuit is configured to output a driving current to the first connection node in response to a first power source signal from the first power source terminal, a gate driving signal from the gate signal terminal, and a first data signal from the first data signal terminal;

the light-emitting control circuit is coupled to the first connection node, the gate signal terminal, a reset signal terminal, a light-emitting control signal terminal, a second power source terminal, a second data signal terminal, a first control node, a second control node, a second connection node, and a light-emitting element, wherein the light-emitting control circuit is configured to output a second power source signal from the second power source terminal to the first connection node and the first control node in response to a reset signal from the reset signal terminal, output a second data signal from the second data signal terminal to the first control node in response to the gate driving signal, control conduction or non-conduction between the second connection node and the light-emitting element in response to a light-emitting control signal from the light-emitting control signal terminal, and control conduction or non-conduction between the first connection node and the second connection node in response to an electric potential of the second control node; and the compensating circuit is coupled to a third power source terminal, the light-emitting control signal terminal, the reset signal terminal, the first control node, the second control node, and the second connection node, wherein the compensating circuit is configured to adjust the electric potential of the second control node according to an electric potential of the first control node, adjust the electric potential of the second control node according to an electric potential of the second connection node in response to the reset signal, and adjust the electric potential of the second control node according to the electric potential of the first control node and a third power source signal from the third power source terminal in response to the light-emitting control signal.

2. The circuit according to claim 1, wherein the compensating circuit comprises a first compensating sub-circuit and a second compensating sub-circuit; wherein the first compensating sub-circuit is coupled to the light-emitting control signal terminal, the third power source terminal, the first control node, and the second control node, wherein the first compensating sub-circuit is configured to adjust the electric potential of the second control node according to the electric potential of the first control node, and adjust the electric potential of the second control node according to the third power source signal and the electric potential of the first control node in response to the light-emitting control signal; and the second compensating sub-circuit is coupled to the reset signal terminal, the second connection node, and the second control node, wherein the second compensating sub-circuit is configured to adjust the electric potential of the second control node according to the electric potential of the second connection node in response to the reset signal.

3. The circuit according to claim 2, wherein the first compensating sub-circuit comprises a first compensating transistor, a second compensating transistor, a compensating capacitor, and a compensating resistor; wherein a gate of the first compensating transistor is coupled to the light-emitting control signal terminal, a first electrode of the first compensating transistor is coupled to the third power source terminal, and a second electrode of the first compensating transistor is coupled to the first control node;

a gate of the second compensating transistor is coupled to the light-emitting control signal terminal, a first electrode of the second compensating transistor is coupled to one terminal of the compensating resistor, and a second electrode of the second compensating transistor is coupled to the second control node;

the other terminal of the compensating resistor is coupled to the third power source terminal; and one terminal of the compensating capacitor is coupled to the first control node, and the other terminal of the compensating capacitor is coupled to the second control node.

4. The circuit according to claim 2, wherein the second compensating sub-circuit comprises a third compensating transistor; wherein a gate of the third compensating transistor is coupled to the reset signal terminal, a first electrode of the third compensating transistor is coupled to the second connection node, and a second electrode of the third compensating transistor is coupled to the second control node.

5. The circuit according to claim 1, wherein the light-emitting control circuit is further configured to output the second power source signal to the light-emitting element in response to the reset signal; and the light-emitting control circuit comprises a first reset sub-circuit, a first data writing sub-circuit, a first light-emitting control sub-circuit, and a switch sub-circuit; wherein the first reset sub-circuit is coupled to the reset signal terminal, the second power source terminal, the first connection node, the first control node, and the light-emitting element, wherein the first reset sub-circuit is configured to output the second power source signal to the first connection node, the first control node, and the light-emitting element in response to the reset signal;

the first data writing sub-circuit is coupled to the gate signal terminal, the second data signal terminal, and the first control node, wherein the first data writing sub-circuit is configured to output the second data signal to the first control node in response to the gate driving signal;

the first light-emitting control sub-circuit is coupled to the light-emitting control signal terminal, the second connection node, and the light-emitting element, wherein the first light-emitting control sub-circuit is configured to control conduction or non-conduction between the second connection node and the light-emitting element in response to the light-emitting control signal; and the switch sub-circuit is coupled to the second control node, the first connection node, and the second connection node, wherein the switch sub-circuit is configured to control conduction or non-conduction between the first connection node and the second connection node in response to the electric potential of the second control node.

6. The circuit according to claim 5, wherein the first reset sub-circuit comprises a first reset transistor, a second reset transistor, and a third reset transistor; wherein gates of the first reset transistor, the second reset transistor, and the third reset transistor are all coupled to the reset signal terminal;

first electrodes of the first reset transistor, the second reset transistor, and the third reset transistor are all coupled to the second power source terminal; and a second electrode of the first reset transistor is coupled to the first connection node, a second electrode of the second reset transistor is coupled to the first control node, and a second electrode of the third reset transistor is coupled to the light-emitting element.

7. The circuit according to claim 5, wherein the first data writing sub-circuit comprises a first data writing transistor; wherein a gate of the first data writing transistor is coupled to the gate signal terminal, a first electrode of the first data writing transistor is coupled to the second data signal terminal, and a second electrode of the first data writing transistor is coupled to the first control node.

8. The circuit according to claim 5, wherein the first light-emitting control sub-circuit comprises a first light-emitting control transistor; wherein a gate of the first light-emitting control transistor is coupled to the light-emitting control signal terminal, a first electrode of the first light-emitting control transistor is coupled to the second connection node, and a second electrode of the first light-emitting control transistor is coupled to the light-emitting element.

9. The circuit according to claim 5, wherein the switch sub-circuit comprises a switch transistor; wherein a gate of the switch transistor is coupled to the second control node, a first electrode of the switch transistor is coupled to the first connection node, and a second electrode of the switch transistor is coupled to the second connection node.

10. The circuit according to claim 1, wherein the pixel circuit further comprises a switch control circuit connected in series between the driving circuit and the first connection node; wherein the switch control circuit is coupled to the light-emitting control signal terminal, the driving circuit, and the first connection node; and the switch control circuit is configured to control conduction or non-conduction between the driving circuit and the first connection node in response to the light-emitting control signal.

11. The circuit according to claim 10, wherein the switch control circuit comprises a switch control transistor; wherein a gate of the switch control transistor is coupled to the light-emitting control signal terminal, a first electrode of the switch control transistor is coupled to the driving circuit, and a second electrode of the switch control transistor is coupled to the first connection node.

12. The circuit according to claim 1, wherein the driving circuit comprises a second data writing sub-circuit, a second reset sub-circuit, a second light-emitting control sub-circuit, a storage sub-circuit, a third compensating sub-circuit, and a driving sub-circuit; wherein the second data writing sub-circuit is coupled to the gate signal terminal, the first data signal terminal, and a third connection node; and the second data writing sub-circuit is configured to output the first data signal to the third connection node in response to the gate driving signal;

the second reset sub-circuit is coupled to the reset signal terminal, the second power source terminal, and a third control node; and the second reset sub-circuit is configured to output the second power source signal to the third control node in response to the reset signal;

the second light-emitting control sub-circuit is coupled to the light-emitting control signal terminal, the first power source terminal, and the third connection node; and the second light-emitting control sub-circuit is configured to output the first power source signal to the third connection node in response to the light-emitting control signal;

the storage sub-circuit is coupled to the third control node and the first power source terminal; and the storage sub-circuit is configured to control an electric potential of the third control node;

the third compensating sub-circuit is coupled to the gate signal terminal, the first connection node, and the third control node; and the third compensating sub-circuit is configured to adjust the electric potential of the third control node according to the electric potential of the first connection node in response to the gate driving signal; and the driving sub-circuit is coupled to the third control node, the third connection node, and the first connection node; and the driving sub-circuit is configured to output a driving current to the first connection node in response to the electric potential of the third control node and an electric potential of the third connection node.

13. The circuit according to claim 12, wherein the second data writing sub-circuit comprises a second data writing transistor; the second reset sub-circuit comprises a fourth reset transistor; the second light-emitting control sub-circuit comprises a second light-emitting control transistor; the storage sub-circuit comprises a storage capacitor; the third compensating sub-circuit comprises a fourth compensating transistor; and the driving sub-circuit comprises a driving transistor; wherein a gate of the second data writing transistor is coupled to the gate signal terminal, a first electrode of the second data writing transistor is coupled to the first data signal terminal, and a second electrode of the second data writing transistor is coupled to the third connection node;

a gate of the fourth reset transistor is coupled to the reset signal terminal, a first electrode of the fourth reset transistor is coupled to the second power source terminal, and a second electrode of the fourth reset transistor is coupled to the third control node;

a gate of the second light-emitting control transistor is coupled to the light-emitting control signal terminal, a first electrode of the second light-emitting control transistor is coupled to the first power source terminal, and a second electrode of the second light-emitting control transistor is coupled to the third connection node;

one terminal of the storage capacitor is coupled to the third control node, and the other terminal of the storage capacitor is coupled to the first power source terminal;

a gate of the fourth compensating transistor is coupled to the gate signal terminal, a first electrode of the fourth compensating transistor is coupled to the first connection node, and a second electrode of the fourth compensating transistor is coupled to the third control node; and a gate of the driving transistor is coupled to the third control node, a first electrode of the driving transistor is coupled to the third connection node, and a second electrode of the driving transistor is coupled to the first connection node.

14. The circuit according to claim 13, wherein the compensating circuit comprises a first compensating transistor, a second compensating transistor, a compensating capacitor, a compensating resistor, and a third compensating transistor; and the light-emitting control circuit comprises a first reset transistor, a second reset transistor, a third reset transistor, a first data writing transistor, a first light-emitting control transistor, and a switch transistor; wherein a gate of the first compensating transistor is coupled to the light-emitting control signal terminal, a first electrode of the first compensating transistor is coupled to the third power source terminal, and a second electrode of the first compensating transistor is coupled to the first control node; a gate of the second compensating transistor is coupled to the light-emitting control signal terminal, a first electrode of the second compensating transistor is coupled to one terminal of the compensating resistor, and a second electrode of the second compensating transistor is coupled to the second control node; the other terminal of the compensating resistor is coupled to the third power source terminal; one terminal of the compensating capacitor is coupled to the first control node, and the other terminal of the compensating capacitor is coupled to the second control node; a gate of the third compensating transistor is coupled to the reset signal terminal, a first electrode of the third compensating transistor is coupled to the second connection node, and a second electrode of the third compensating transistor is coupled to the second control node;

gates of the first reset transistor, the second reset transistor, and the third reset transistor are all coupled to the reset signal terminal; first electrodes of the first reset transistor, the second reset transistor, and the third reset transistor are all coupled to the second power source terminal; a second electrode of the first reset transistor is coupled to the first connection node, a second electrode of the second reset transistor is coupled to the first control node, and a second electrode of the third reset transistor is coupled to the light-emitting element; a gate of the first data writing transistor is coupled to the gate signal terminal, a first electrode of the first data writing transistor is coupled to the second data signal terminal, and a second electrode of the first data writing transistor is coupled to the first control node; a gate of the first light-emitting control transistor is coupled to the light-emitting control signal terminal, a first electrode of the first light-emitting control transistor is coupled to the second connection node, and a second electrode of the first light-emitting control transistor is coupled to the light-emitting element; a gate of the switch transistor is coupled to the second control node, a first electrode of the switch transistor is coupled to the first connection node, and a second electrode of the switch transistor is coupled to the second connection node;

the pixel circuit further comprises a switch control transistor; wherein a gate of the switch control transistor is coupled to the light-emitting control signal terminal, a first electrode of the switch control transistor is coupled to the driving circuit, and a second electrode of the switch control transistor is coupled to the first connection node.

15. A method for driving the pixel circuit as defined in claim 1, the method comprising:

a reset stage, in which an electric potential of a reset signal supplied by the reset signal terminal is a first electric potential; the light-emitting control circuit outputs the second power source signal from the second power source terminal to the first connection node and the first control node in response to the reset signal; the compensating circuit adjusts the electric potential of the second control node according to the electric potential of the first control node; the light-emitting control circuit further controls conduction between the first connection node and the second connection node in response to the electric potential of the second control node; and the compensating circuit further adjusts the electric potential of the second control node according to the electric potential of the second connection node in response to the reset signal;

a data writing stage, in which an electric potential of the gate driving signal supplied by the gate signal terminal is the first electric potential; the light-emitting control circuit outputs the second data signal from the second data signal terminal to the first control node in response to the gate driving signal; and the compensating circuit adjusts the electric potential of the second control node according to the electric potential of the first control node; and a light-emitting control stage, in which the driving circuit outputs the driving current to the first connection node in response to the first power source signal from the first power source terminal, the gate driving signal, and the first data signal from the first data signal terminal; an electric potential of the light-emitting control signal supplied by the light-emitting control signal terminal is the first electric potential; the compensating circuit adjusts the electric potential of the second control node according to the electric potential of the first control node and the third power source signal from the third power source terminal in response to the light-emitting control signal; and the light-emitting control circuit controls conduction between the first connection node and the second connection node in response to the electric potential of the second control node, and controls conduction between the second connection node and the light-emitting element in response to the light-emitting control signal.

16. A display substrate comprising a plurality of pixel units, wherein at least one of the plurality of pixel units comprises a light-emitting element, and a pixel circuit coupled to the light-emitting element, wherein the pixel circuit comprises: a driving circuit, a light-emitting control circuit, and a compensating circuit; wherein the driving circuit is coupled to a first power source terminal, a gate signal terminal, a first data signal terminal, and a first connection node, wherein the driving circuit is configured to output a driving current to the first connection node in response to a first power source signal from the first power source terminal, a gate driving signal from the gate signal terminal, and a first data signal from the first data signal terminal;

the light-emitting control circuit is coupled to the first connection node, the gate signal terminal, a reset signal terminal, a light-emitting control signal terminal, a second power source terminal, a second data signal terminal, a first control node, a second control node, a second connection node, and a light-emitting element, wherein the light-emitting control circuit is configured to output a second power source signal from the second power source terminal to the first connection node and the first control node in response to a reset signal from the reset signal terminal, output a second data signal from the second data signal terminal to the first control node in response to the gate driving signal, control conduction or non-conduction between the second connection node and the light-emitting element in response to a light-emitting control signal from the light-emitting control signal terminal, and control conduction or non-conduction between the first connection node and the second connection node in response to an electric potential of the second control node; and the compensating circuit is coupled to a third power source terminal, the light-emitting control signal terminal, the reset signal terminal, the first control node, the second control node, and the second connection node, wherein the compensating circuit is configured to adjust the electric potential of the second control node according to an electric potential of the first control node, adjust the electric potential of the second control node according to an electric potential of the second connection node in response to the reset signal, and adjust the electric potential of the second control node according to the electric potential of the first control node and a third power source signal from the third power source terminal in response to the light-emitting control signal.

17. The display substrate according to claim 16, the light-emitting element comprises a micro light-emitting diode.

18. A display device, comprising a signal driving circuit and the display substrate as defined in claim 16; wherein the signal driving circuit is coupled to each signal terminal of the pixel circuit comprised in the display substrate, and is configured to supply signal to the each signal terminal.

19. The display substrate according to claim 16, wherein the compensating circuit comprises a first compensating sub-circuit and a second compensating sub-circuit; wherein the first compensating sub-circuit is coupled to the light-emitting control signal terminal, the third power source terminal, the first control node, and the second control node, wherein the first compensating sub-circuit is configured to adjust the electric potential of the second control node according to the electric potential of the first control node, and adjust the electric potential of the second control node according to the third power source signal and the electric potential of the first control node in response to the light-emitting control signal; and the second compensating sub-circuit is coupled to the reset signal terminal, the second connection node, and the second control node, wherein the second compensating sub-circuit is configured to adjust the electric potential of the second control node according to the electric potential of the second connection node in response to the reset signal.

20. The display substrate according to claim 19, wherein the first compensating sub-circuit comprises a first compensating transistor, a second compensating transistor, a compensating capacitor, and a compensating resistor; wherein a gate of the first compensating transistor is coupled to the light-emitting control signal terminal, a first electrode of the first compensating transistor is coupled to the third power source terminal, and a second electrode of the first compensating transistor is coupled to the first control node;

a gate of the second compensating transistor is coupled to the light-emitting control signal terminal, a first electrode of the second compensating transistor is coupled to one terminal of the compensating resistor, and a second electrode of the second compensating transistor is coupled to the second control node;

the other terminal of the compensating resistor is coupled to the third power source terminal; and one terminal of the compensating capacitor is coupled to the first control node, and the other terminal of the compensating capacitor is coupled to the second control node.

* * * * *